US007383892B2

(12) United States Patent
Jackson

(10) Patent No.: US 7,383,892 B2
(45) **Date of Patent: *Jun. 10, 2008**

(54) PREACTION FIRE EXTINGUISHING SYSTEM FOR ESFR COLD STORAGE APPLICATIONS

(75) Inventor: Eldon D. Jackson, Hastings, MI (US)

(73) Assignee: The Viking Corporation, Hastings, MI (US)

( * ) Notice: Subject to any disclaimer, the term of this patent is extended or adjusted under 35 U.S.C. 154(b) by 372 days.

This patent is subject to a terminal disclaimer.

(21) Appl. No.: 10/935,255

(22) Filed: Sep. 7, 2004

(65) Prior Publication Data

US 2005/0072580 A1 Apr. 7, 2005

Related U.S. Application Data

(60) Provisional application No. 60/500,434, filed on Sep. 5, 2003.

(51) Int. Cl.
*A62C 35/00* (2006.01)

(52) U.S. Cl. ..... 169/16; 169/37; 169/54; 169/61; 239/69; 239/208; 239/303; 239/565; 137/79; 137/266; 137/565.33

(58) Field of Classification Search ..... 169/5, 169/8, 14, 15, 16, 19, 20, 37, 54, 56, 60, 169/61; 239/74, 208, 67, 69, 303–305, 565; 137/266, 79, 565.33, 460
See application file for complete search history.

(56) References Cited

U.S. PATENT DOCUMENTS 3,702,636 A * 11/1972 Hart ..... 169/54
3,878,898 A * 4/1975 Marshall ..... 169/60
3,993,139 A * 11/1976 Vaughn ..... 169/62
4,019,581 A * 4/1977 Diggs ..... 169/16
6,263,974 B1 * 7/2001 Sundholm ..... 169/62
6,367,560 B1 * 4/2002 de Ris et al. ..... 169/43
6,491,109 B2 * 12/2002 Christenson et al. ..... 169/17

OTHER PUBLICATIONS

Technical Specification Entitled "Model ESFR-25™ Storage System: Suppression Mode Fire Sprinkler For Storage In Refrigerated Areas", (16 pages) dated Feb. 2002.

* cited by examiner

*Primary Examiner*—Steven J Ganey
(74) *Attorney, Agent, or Firm*—Harness, Dickey & Pierce, P.L.C.

(57) ABSTRACT

An early suppression fast response fire protection system includes a sprinkler piping system with at least one sprinkler head assembly, a water supply system, and a check valve in fluid communication with the sprinkler piping system and the water supply system. An antifreeze solution supply system is in fluid communication with the sprinkler piping system, with the check valve isolating the antifreeze solution from the water supply unless a fire condition occurs. A control is provided that is in communication with a flow detector, which detects the pressure of the antifreeze solution in the sprinkler piping system, and a pressure detector, which detects the flow of water through the check valve, and controls the flow of the antifreeze solution to the sprinkler piping system and maintains the pressure of the antifreeze solution in the sprinkler piping system unless the flow detector detects the flow of water through the check valve in which case the control stops the flow of antifreeze solution to the sprinkler piping system to limit the discharge of antifreeze solution from the fire protection system.

28 Claims, 16 Drawing Sheets

SYSTEM SELECTION IN FILL MODE (HAND) AS FOLLOWS:

SYSTEM 1 SWITCH A - UP
SWITCH B - CENTER

SYSTEM 2 SWITCH A - DOWN
SWITCH B - CENTER

SYSTEM 3 SWITCH A - CENTER
SWITCH B - UP

SYSTEM 4 SWITCH A - CENTER
SWITCH B - DOWN

SYSTEM 5 SWITCH A - UP
SWITCH B - UP

SYSTEM 6 SWITCH A - DOWN
SWITCH B - DOWN

FIG 8
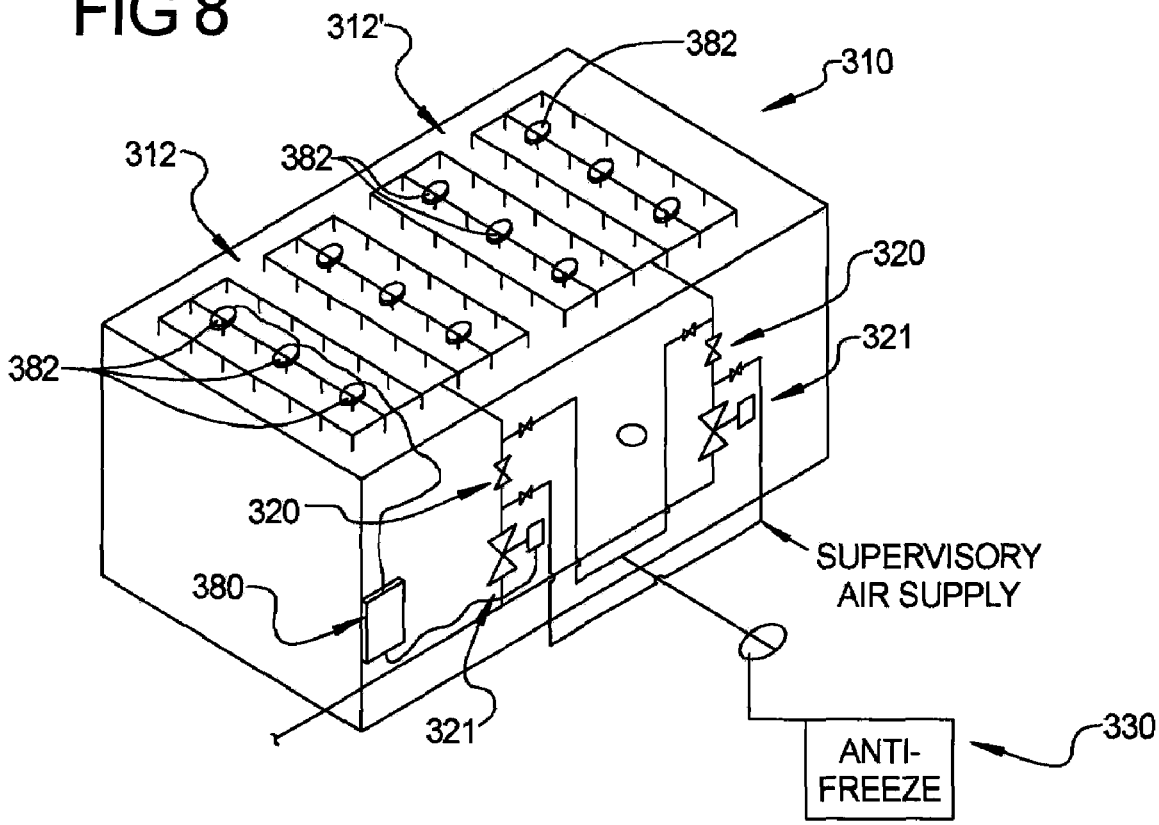
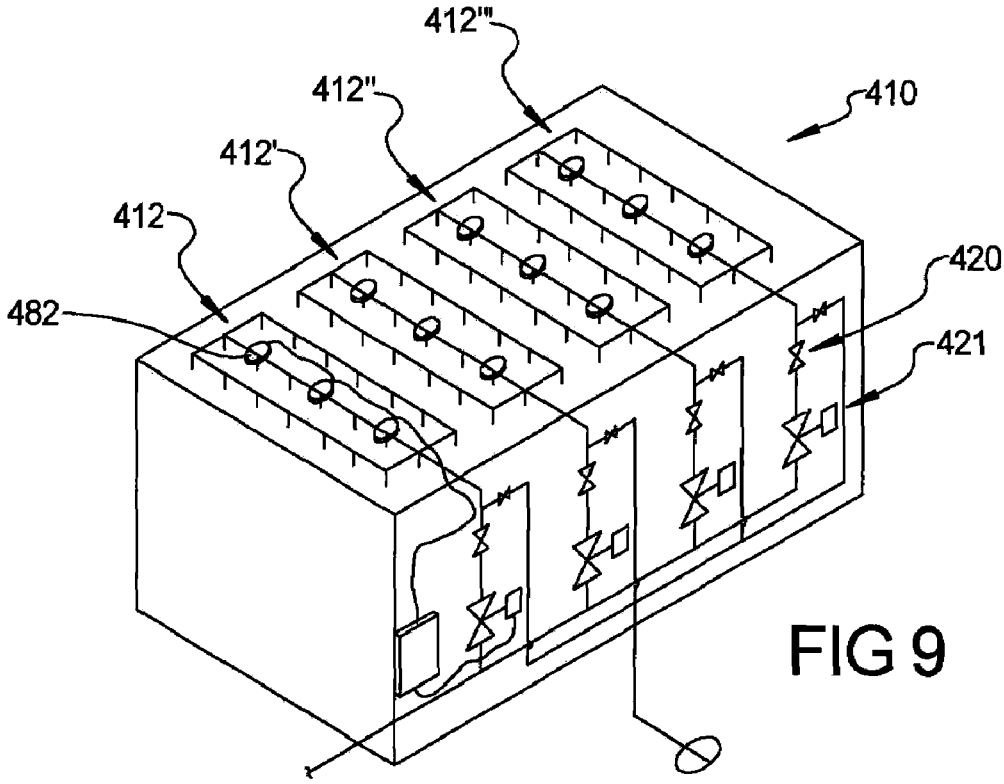
FIG 9

PREACTION FIRE EXTINGUISHING SYSTEM FOR ESFR COLD STORAGE APPLICATIONS

This application claims priority from U.S. provisional application Ser. No. 60/500,434, filed Sep. 5, 2003, entitled PREACTION FIRE EXTINGUISHGING SYSTEM FOR ESFR COLD STORAGE APPLICATIONS, which is incorporated herein in its entirety.

TECHNICAL FIELD AND BACKGROUND OF THE INVENTION

The present invention generally relates to fire protection systems for cold environments and, more specifically, for cold storage environments.

In fire protection sprinkler systems used in warehouse freezers and other cold storage environments, sprinkler piping system, which is typically connected to a water supply through a control valve and check valve, extends through a cold environment to sprinklers that are positioned in the freezer or cold storage environment to discharge extinguishant. The piping passing through the cold environment must contain a solution or a gas that will not freeze during normal set conditions. For large warehouse applications using early suppression fast response (ESFR) sprinklers, high piled storage can be protected using only ceiling mounted sprinklers. This means that in-rack sprinklers are not required at the various levels of rack storage areas to properly protect stored materials and the building from fire. Currently, preaction systems are limited to freezer systems using standard orifice type sprinklers at the ceiling and in-rack sprinklers in the adjacent rack storage areas.

Preaction sprinkler systems include a control or deluge valve, closed sprinklers, an air supervised piping system, and a detection system, which is electric or hydraulic/pneumatic. The detection system operates prior to the sprinkler operation in order to fill or pressurize the sprinkler piping system with water prior to operation of the sprinklers. With rapid operation of the detection system prior to sprinkler fused link operation, the piping system can fill with water prior to operation of the sprinklers. This allows the sprinkler system to be considered as a wet-pipe system, thus requiring less flow of sprinkler water after operation of system.

For ESFR applications it is important to have water or other extinguishing agents at the sprinklers before operation of the sprinklers from heat activated link of the sprinklers. Also current methods in application of ESFR sprinklers incorporate gridded-piping systems that allow water to be supplied to sprinklers in all locations at the ceiling from two directions. Also they are applied using wet-pipe technology that fills the complete system with antifreeze liquid that is premixed for the allowable low temperature of the environment, such as a freezer. In these systems when a single or multiple sprinklers operate, the amount of antifreeze discharged comes from the total system, piping network that can be very large. If a sprinkler is broken and no fire is present, the complete system is contaminated with plain water and must be drained immediately and replenished with proper antifreeze solution. If the antifreeze supply pump fails and a low pressure condition occurs the water supply can force its way into the antifreeze solution causing contamination resulting in freezing of the sprinkler piping systems. In a fire condition when water enters the system the complete piping system holding antifreeze is also contaminated and areas where water is not flowing are susceptible to freezing during a fire condition.

SUMMARY

The present invention provides an ESFR preaction system, which uses an antifreeze solution, including a propylene glycol antifreeze, gas, potassium lactate or air as a supervising medium in the sprinkler piping system of the cold area being protected. By using the antifreeze solution or other mediums as a supervisory medium of the sprinkler piping integrity in combination with the detection system prior to operation of the preaction deluge or flow control valve, insurance of fire will prevent costly contamination of antifreeze solution with water if a false situation of fire or a broken sprinkler is developed. This system can be applied using looped, gridded or tree type piping systems. Also included in the preaction system of the present invention are features of the copending application Ser. No. 10/438,726, filed May 15, 2003, assigned to The Viking Corporation of Hastings, Mich., (which is incorporated by reference herein in its entirety), which operates from auxiliary power if available or from pneumatic or hydraulic operation if power is lost. The failsafe feature allows the system deluge valve to remain closed if no fire is detected from a detection system. If a sprinkler breaks or piping system is damaged and no fire is detected by the detection system, the system will only discharge antifreeze solution and not allow water to enter system. If a fire is detected by the detection system, the deluge valve will open prior to sprinklers and will pressurize system for extinguishment of fire.

In current wet pipe antifreeze type systems, when antifreeze solution is pumped into the piping system and separated from the water supply using a check valve arrangement the antifreeze solution must be pressurized at a higher pressure than the water supply in order to prevent contamination by water thus causing a freeze condition in the sprinkler piping. With the preaction system of the present invention, a check valve is used to hold back the antifreeze solution in the sprinkler-piping network in the cold area of protection. Also the preaction system of the present invention includes a control valve that holds back the sprinkler high-pressure water supply. The control valve is also attached to a detection system that can be pneumatic or electric controlled. The piping below the check valve and above the outlet of the preaction deluge valve is atmospheric or low air pressure that can be supervised. Thus the pressure in the piping system containing antifreeze solution may be maintained at a much lower pressure and supervised using pressure switches for integrity of the piping system. The antifreeze solution can be replenished automatically or provide an alarm condition for manual attention of the system without contamination of antifreeze solution from water. The preaction deluge or control valve holds back the water supply until the detection system operates because of a fire condition. Water is then released by the deluge valve and supplied to the sprinkler system. The sprinklers are all closed and only those in the area of the fire are open due to heat applied to the fusible link of each sprinkler.

With the ESFR preaction cold storage system of the present invention it is possible to break up the system into smaller gridded or branch-type systems that allow isolation of the area of operation or supervision of piping system. By adding systems in multiples, rather than one complete system, less damage to piping system is caused from freezing if minimum number of sprinklers operate or contamination of the piping system supervisory solution is caused by leakage from water supply.

When the sprinkler piping system of the present invention uses a single large grid-type piping arrangement, liquid or gas antifreeze solution must be used as the supervising medium and detected by the preaction system alarm system that will not act as an accelerant to the spread of the fire. This is due to the complete piping system being supplied from one common water supply point in a grid arrangement. This type of system contains large amounts of solution and will require extended period of flow time to expel prior to flow of water extinguishment solution. This type of system should not be used with air unless large air exhausters are applied due to the length of time required to expel air and fill the system with water. With the ESFR cold storage system of the present invention a combination of antifreeze in the immediate cold area of protection from the system check valve to the sprinkler can be used and the section of piping from the check valve to the preaction control valve can utilize low pressure air to supervise the integrity of the system and perform as failsafe system in the event of power loss to area of protection for extended period of time.

When using air as a supervisory medium in the sprinkler piping of an ESFR application, the operation of the preaction deluge valve releasing water to the sprinkler system must occur prior to the sprinkler operation to insure that water flows from the sprinkler at the required time to extinguish the fire per fire testing that has proven the ESFR system. This requires operation differential of the preaction valve prior to the sprinkler operation from fire that will fill the piping with water based on the water supply capacity and the volume of piping to be filled. When using air in the cold piping area, the ESFR preaction system of the present invention can use a multiple riser branch pipe system where a limited number of branch lines are connected (typically three (3)) to a common feed line and isolated from the remainder of the system using a selector deluge type valve. If multiple branch systems are applied based on the building size, the pressure of the antifreeze solution must be equal to or greater than the water supply pressure in order to not contaminate the rest of the piping sprinkler system with water when a single area operates or is damaged. When the system is broken up into smaller operating areas, the operation of the fire area will not contaminate the rest of the system by causing freeze plugs. Also more rapid transit of water to sprinklers in the fire area is obtainable for ESER applications when using a preaction system. Also when using air or antifreeze as the supervisory medium, a dry pendent ESFR sprinkler is desired or an upright sprinkler. These type sprinklers isolate the water in the areas that did not operate their sprinklers. This allows water to drain from the system and not pocket in areas that can freeze in the cold protected area, when pendent sprinklers are applied they must be manually removed and drained to prevent pockets that will freeze.

A combination of check valve to isolate antifreeze solution and low pressure supervisory air and deluge preaction control valve to isolate sprinkler water supply from system controlled by a combination of air supervisory devices and a detection system make up another combination of the ESFR preaction system of the present invention for precise control of the suppression system and control of water entering the antifreeze solution in the cold storage area being protected.

In one form of the invention, an early suppression fast response fire protection system includes a sprinkler piping system with at least one sprinkler head assembly, a water supply system, and a check valve. The outlet of the check valve is in fluid communication with the sprinkler piping system and the inlet of the check valve is in fluid communication with the water supply system. The system also includes an antifreeze solution supply system, which is in fluid communication with the sprinkler piping system. The check valve isolates the antifreeze solution from the water supply unless a fire condition occurs. A pressure detector, which detects the pressure of the antifreeze solution in the sprinkler piping system, a flow detector, which detects the flow of water through the check valve when the check valve is opened, and a control, which is in communication with the flow detector and the pressure detector, are also provided. The control controls the flow of the antifreeze solution to the sprinkler piping system and maintains the pressure of the antifreeze solution in the sprinkler piping system unless the flow detector detects the flow of water through the check valve in which case the control stops the flow of antifreeze solution to the sprinkler piping system to limit the discharge of antifreeze solution from the fire protection system.

In one aspect, the check valve includes an antifreeze supply inlet, with the antifreeze solution supply system in fluid communication with the antifreeze supply inlet of the check valve.

In another aspect, the check valve includes an alarm port, with the flow detector detecting the flow of water through the check valve through the alarm port.

According to yet another aspect, the system further includes a second sprinkler piping system with at least one sprinkler head assembly and a second check valve with an outlet in fluid communication with the second sprinkler piping system and an inlet in fluid communication with the water supply system. The antifreeze solution supply system is in fluid communication with the second sprinkler piping system, with the second check valve isolating the antifreeze solution in the second sprinkler piping system from the water supply unless a fire condition occurs. A second pressure detector, which detects the pressure of the antifreeze solution in the second sprinkler piping system, and a second flow detector, which detects the flow of water through the second check valve when the second check valve is opened are provided. The control, which is in communication with the second flow detector and the second pressure detector, controls the flow of antifreeze system to the second piping sprinkler and maintains the pressure of the antifreeze solution in the second sprinkler piping system unless the second flow detector detects the flow of water through the second check valve in which case the control stops the flow of antifreeze solution to the second sprinkler piping system to limit the discharge of antifreeze solution from the fire protection system.

In a further aspect, at least one of said sprinkler piping systems comprises a tree configuration with a center or side feed main line and at least two branch lines extending from the center main line.

In another aspect, the system further includes a control valve, which is in fluid communication with the water supply inlet of the check valve. The control valve may be used to isolate the water supply from the check valve and the sprinkler piping system until a fire is detected. In this manner, the antifreeze solution may be maintained at a lower pressure.

In a further aspect, the outlet of the control valve is in fluid communication with the inlet of the check valve through a conduit, with the conduit filled with air. In addition, the system may include an air pressure monitoring system that monitors the air pressure in the conduit, with the control in communication with the air pressure monitoring system.

Additionally, the system may also include at least one fire detector and a control system, with the control system in communication with the fire detector, the air pressure monitoring system, and the control valve, with the control system actuating the control valve to open in response to the detector detecting a fire condition and the air pressuring monitoring system detecting a pressure drop in the conduit.

According to another form of the invention, an early suppression fast response fire protection system includes a plurality of sprinkler piping systems, with each sprinkler piping system having at least one sprinkler head assembly, a water supply system, a check valve for each sprinkler piping system, with the outlets of each check valve in fluid communication with one of the sprinkler piping systems and each of the inlets of the check valves in fluid communication with the water supply system, and an antifreeze solution supply system in fluid communication with each of the sprinkler piping systems. Each check valve isolates the antifreeze solution in its associated sprinkler piping system from the water supply unless a fire condition occurs. Pressure detectors detect the pressure of the antifreeze solution in each of the sprinkler piping system. Flow detectors detect the flow of water through each of the check valves when a respective check valve is opened. In addition, a control is provided that is in communication with the flow detectors and the pressure detectors, which controls the flow of antifreeze solution to each of the sprinkler piping systems and maintains the pressure of the antifreeze solution in each of the sprinkler piping systems unless a flow detector detects the flow of water through a respective check valve in which case the control stops the flow of antifreeze solution to the sprinkler piping system associated with the check valve with water flow to limit discharge of antifreeze solution from the fire protection system.

In one aspect, the sprinkler head assemblies each have a K-factor in a range of 11 to 50.

In other aspects, each of the sprinkler head assemblies comprises a pendent or an upright sprinkler.

In yet another aspect, the system includes control valves such as deluge valves, in fluid communication with the water supply system and in fluid communication with each of the sprinkler piping systems. In a further aspect, the system includes at least one fire detector associated with each sprinkler piping system. The control valves control the flow of water from the water supply to the check valves by opening flow between the water supply to one or more check valves when a fire detector associated with one ore more sprinkler piping systems detects a fire.

In another form of the invention, an early suppression fast response fire protection system includes a first sprinkler piping system with at least one sprinkler head assembly, a second sprinkler piping system with at least one sprinkler head assembly, a water supply system, a first check valve with an outlet in fluid communication with the first sprinkler piping system and an inlet in fluid communication with the water supply system, and a second check valve with an outlet in fluid communication with the second sprinkler piping system and an inlet in fluid communication with the water supply system. The system further includes a first control valve in fluid communication with the water supply system and the inlet of the first check valve, a second control valve in fluid communication with the water supply system and with the inlet of the second check valve, and an air pressure supply system in fluid communication with the first sprinkler piping system and the second sprinkler piping system, which supplies air to the sprinkler piping system. First and second air pressure detectors are provided for detecting the pressure of the air in the respective sprinkler piping system. First and second fire detectors associated with the respective sprinkler piping systems are also provided. The system further includes a control system in communication with the control valves, the fire detectors, and the air pressure detectors, which actuates the first control valve to open when the fire detector associated with the first sprinkler piping system detects a fire and the first air pressure detector detects a drop in the air in the first piping system and actuates the second control valve to open when the second fire detector detects a fire and the second air pressure detects a pressure drop in the air in the second piping system.

According to yet another embodiment of the present invention, a fire suppression system includes a sprinkler piping system having at least one sprinkler head assembly, a water supply system, a check valve in fluid communication with the sprinkler piping system, a deluge valve in selective fluid communication with the check valve for controlling flow of water to the sprinkler piping system, at least one fire detector for detecting a fire condition, and an antifreeze solution supply system in fluid communication with the sprinkler piping system. The check valve isolates the antifreeze solution from the water supply system unless a fire condition occurs and the deluge valve is opened. A pressure detector is provided for detecting the pressure of the antifreeze solution in the sprinkler piping system. The system also includes a control in communication with the pressure detector, which supplies the antifreeze solution to the sprinkler piping system and maintains the pressure of said antifreeze solution in the sprinkler piping system, and a control system. The control system includes a pneumatic actuator that monitors the pressure between the check valve and the deluge valve, and is in communication with the fire detector, a source of power, and the deluge valve. The control system is adapted to actuate the deluge valve to open in response to the fire detector detecting a fire condition and a low pressure condition between the check valve and the deluge valve. The control system also actuates the deluge valve open when the pneumatic actuator detects a drop in pressure between the check valve and the deluge valve and when the control system experiences a loss of power from the source of power. In addition, the control stops the flow of antifreeze solution to the sprinkler piping system to limit the discharge of antifreeze solution from the fire protection system when the control detects either a drop of pressure between the check valve and the deluge valve or the flow of water through the deluge valve.

As would be understood, the present fire protection system that is suitable for use in a cold environment and provides enhanced control of the antifreeze solution. These and other objects, advantages, purposes, and features of the invention will become more apparent from the study of the following description taken in conjunction with the drawings.

DESCRIPTION OF THE DRAWINGS

FIG. 8 is a schematic view of an ESFR fire protection system of the present invention with multiple sprinkler piping systems that are supervised by air and antifreeze solution;

FIG. 9 is a schematic piping drawing of an ESFR fire protection system that incorporates a preaction control with air supervision only;

DETAILED DESCRIPTION OF THE PREFERRED EMBODIMENTS

Figure 1:
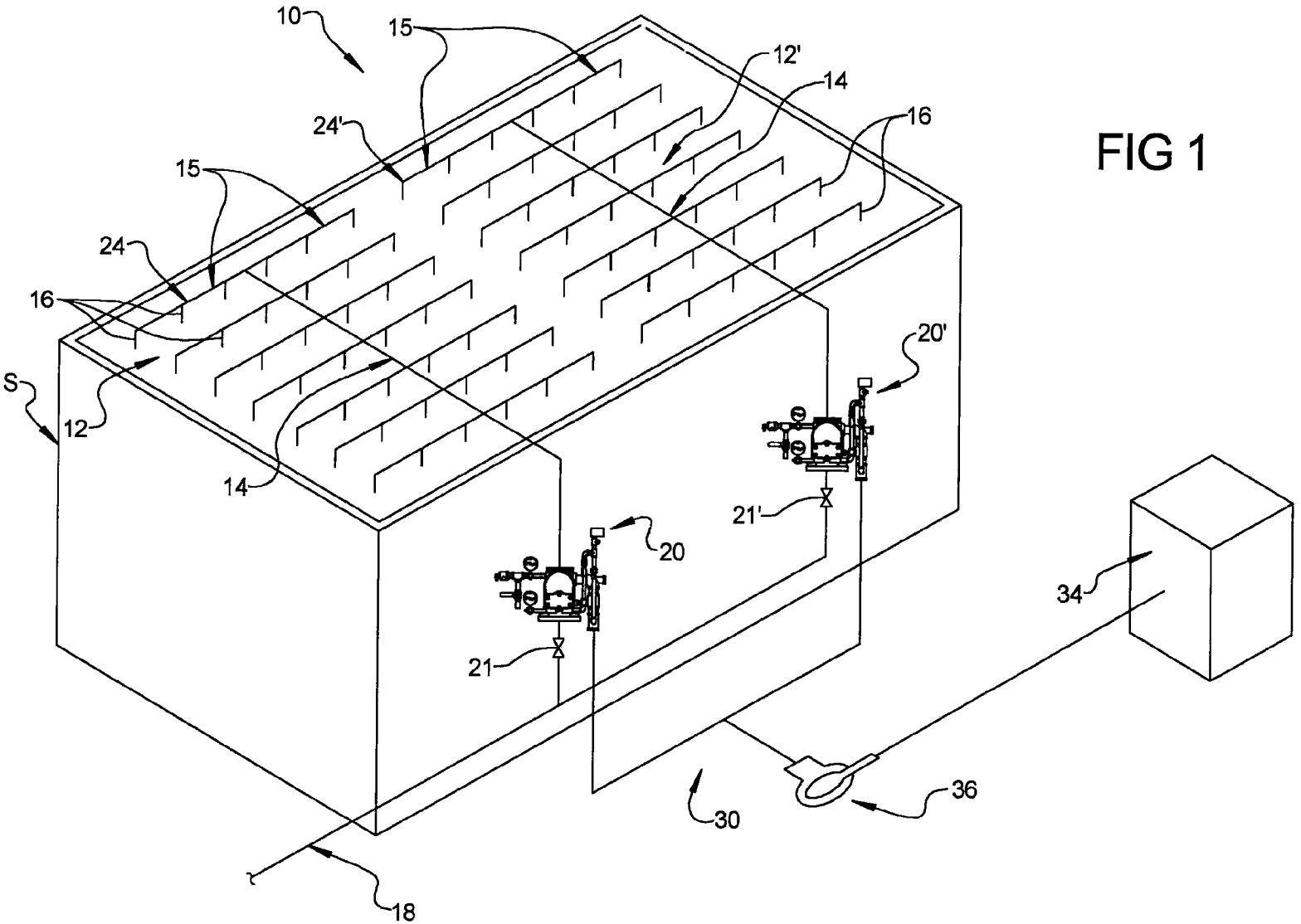
FIG. 1 is a schematic piping drawing of an early suppression fast response (ESFR) fire protection system of the present invention that is suitable for a cold storage application, incorporating sprinkler piping system in a tree configuration.
Figure 2:
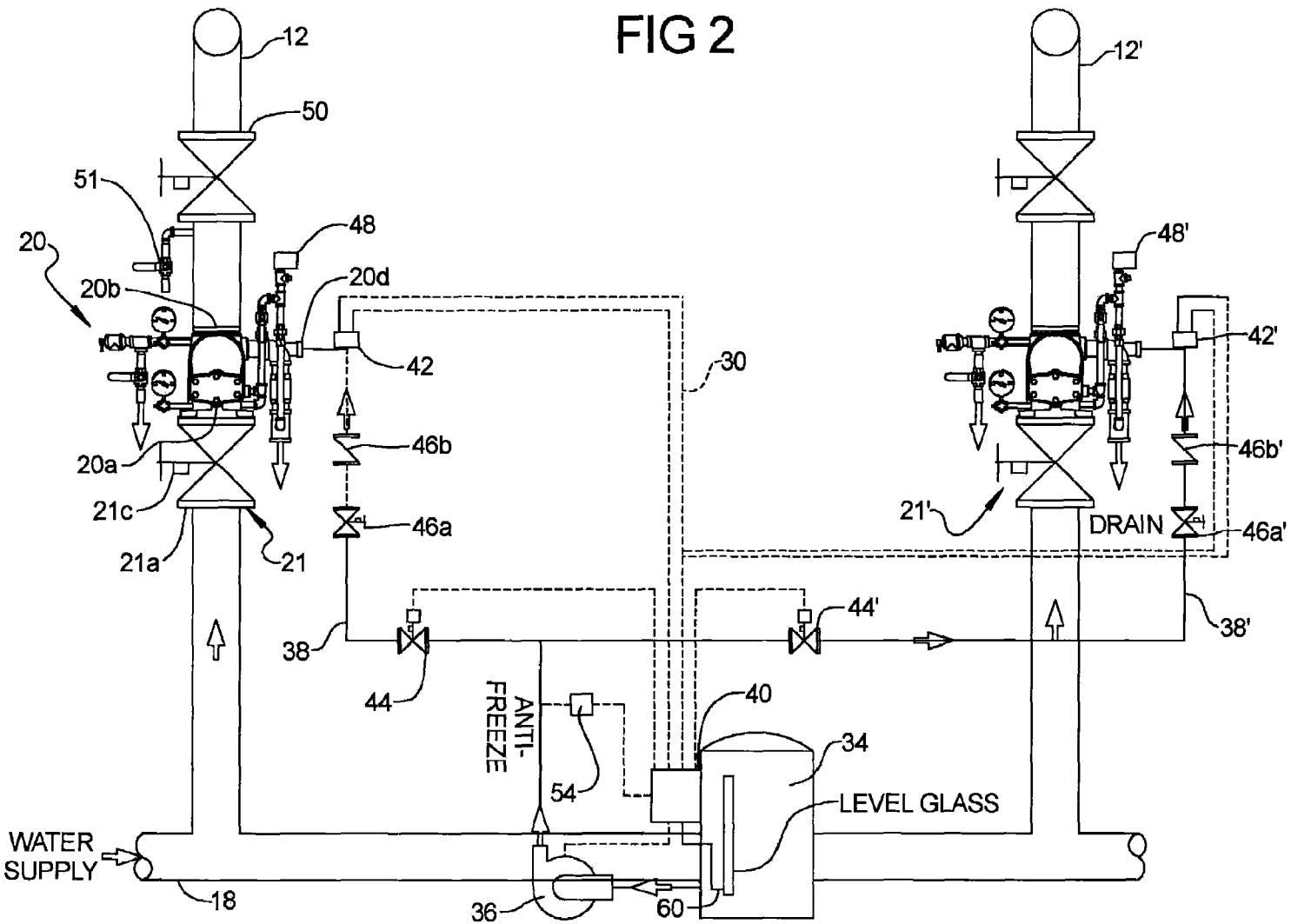
FIG. 2 is a piping and control schematic of the water supply side and antifreeze supply side of the system of FIG. 1.
Figure 3:
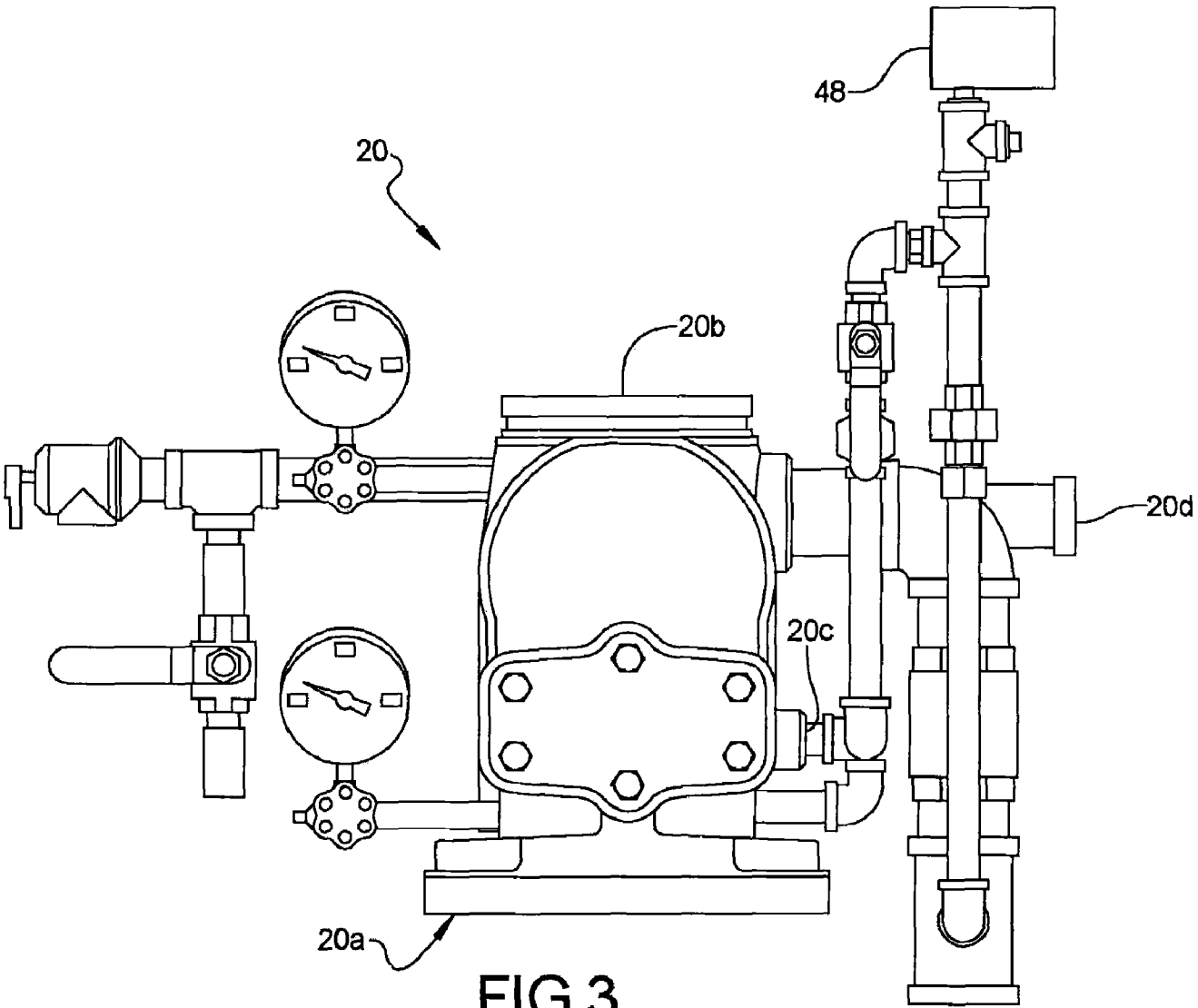
FIG. 3 is an enlarged view of the check valve and the check valve trim of the system of FIG. 1.

Referring to FIG. 1, the numeral 10 generally designates an early suppression fast response (ESFR) fire protection system of the present invention that is particularly suitable for cold storage applications. System 10 is a fixed fire protection system suitable for refrigerated or cold warehouse storage, but which may be appropriate for unheated storage applications in areas subject to cold temperatures, including freezing temperatures. As will be more fully described below, system 10 includes two or more sprinkler piping systems 12, 12' that are separately controlled and filled with an antifreeze and water solution, which are maintained by an antifreeze solution supply system that controls and maintains the antifreeze and water at a desired solution pressure.

In the illustrated embodiment, system 10 includes two sets of sprinkler piping systems 12, 12', which are arranged in a tree configuration, each with a central main pipe 14 and a plurality of branch lines 15. Branch lines 15 each include a plurality of sprinkler head assemblies 16, which comprise closed heat sensitive pendent or upright sprinklers with a K-factor at a range of 11 to 50 and with an ordinary temperature reading in a range of 155° F. to 185° F., and optionally, with a K-factor in a range of 15-30 and more typically of about 25 and a temperature of about 165° F. As will be more fully described below, the number of sprinkler piping systems may be increased or decreased as needed depending on the size of the cold storage area to be protected. For ease of description, reference hereinafter will be generally made to sprinkler piping system 12.

As best seen in FIG. 1, sprinkler piping system 12 is in a refrigerated or cold storage area S, with central main pipe 14 exiting storage area S for connection to the water supply line 18 through a check valve 20 and a control valve 21, which are configured to isolate the antifreeze and water solution mixture from the water supply until such a time that a fire is detected in the storage area S. As noted above, sprinkler piping system 12 is arranged in tree configuration with a plurality of branch lines 15 extending from central main pipe 14, with each of the branch lines 15 having a plurality of sprinkler head assemblies 16. In the illustrated embodiment, storage area S is protected by two sets of sprinkler piping systems 12, 12', which are isolated from each other by their respective check valves 20 and 20' and control valves 21 and 21'. As noted above, for ease of description, hereinafter, the operation of the individual sprinkler piping systems will be made in reference to sprinkler piping system 12 and valves 20 and 21; though it should be understood that the same description applies to sprinkler piping system 12' and valves 20' and 21'.

As will be more fully appreciated from the description that follows, cold storage area S is protected by isolated systems of sprinkler piping systems in order to reduce the area covered by each of the respective sprinkler piping systems, which reduces the amount of antifreeze solution that is released when the overall system is actuated. With a center feed main pipe supplying the branch line, the flow of water is directed to the first open sprinkler head assembly when the system is triggered to allow the antifreeze solution to be expelled form the branch lines and the main line leading directly to the open sprinkler head assembly, which results in the water being replaced in the system much faster than, for example, in a conventional grid type system. Therefore, by segregating areas of the cold storage area S into discrete areas, with each area having one sprinkler piping system, the responsiveness of each sprinkler piping system is increased. Further, as will be understood, with a tree-type piping configuration, the system is easier to set up for drainage.

As previously noted, the antifreeze solution is isolated from the supply water by check valve 20 and control valve 21, which is configured to initiate an alarm during a sustained flow of water (such as the flow required by an open sprinkler) by operating an optional water monitor alarm and alarm pressure switch. In addition, an external bypass line that is normally provided that prevents unwanted false alarms at lower flows has been eliminated in order to provide an alarm if water flows into the system. Check valve 20 includes an inlet 20*a*, which is in fluid communication with the outlet of control valve 21, and an outlet 20*b* which is in fluid communication with piping system 12. As noted previously, the antifreeze and water mixture in piping system 12 is pressurized, which maintains the clapper of the check valve in a closed position against the seat of the valve. However, during a sustained flow of water, such as the flow required by an open sprinkler, the pressure in the antifreeze solution disperses so that the hinge clapper moves off the seat of the valve to the open position to allow the water supply to flow through the check valve and into the sprinkler piping system 12.

Valve 20 also includes an alarm port 20*c* such that when water flows through the open valve and enters the alarm port, an alarm device described more fully below will be activated. Inlet 21*a* of control valve 21 is in communication with water supply piping 18 and, further, may be attached to a detection system that can be pneumatically or electrically controlled, as will be more fully described below. In the illustrated embodiment, the piping below check valve 20 and above outlet of valve 21 is at atmosphere or low pressure and, as will be more fully described below, may be supervised.

The antifreeze and water solution is delivered to piping system 12 through an antifreeze solution supply system 30, which delivers the antifreeze solution to piping system 12 through a second inlet 20*d* of check valve 20. Antifreeze supply system 30 includes a tank 34 and pump 36 that automatically maintains the antifreeze solution pressure in piping system 12 above the pressure value of check valve 20 until a sprinkler is activated. Pump 36 uses the antifreeze and storage tank to maintain system pressure and make up for minor system leaks.

Tank 34 holds a premix of antifreeze solution, for example a premix of propylene glycol and water in a range of 20% to 65% parts of water solution and optionally in a range of 35% to 50% propylene glycol/water solution. As noted above, the propylene glycol water premix solution is used to precharge the system and control the fire, followed with water to suppress the fire. The propylene glycol and water mixture cools and adds wetting ability to control the fire until the water is supplied to suppress the fire. Preferably, when filling the piping system with antifreeze solution, all air must be bled from the system in order to maintain the antifreeze solution pressure non-compressible. It should be understood that the sprinkler piping systems may be filled with a gas, such as air, or other fluids, potassium lactate or the like.

As noted above, the antifreeze solution is pumped from tank 34 by pressure pump 36, which delivers the antifreeze solution to inlet 20*d* of check valve 20 through conduit 38. To control the flow of antifreeze solution to sprinkler piping system 12, antifreeze system 30 includes a control 40, a plurality of switches 42, 54, and at least one solenoid valve 44. Control 40 comprises a controller, such as a programmable logic controller (PLC) 41, that monitors pressure switch 42, which detects the pressure of the antifreeze solution in piping system 12, and monitors pressure switch 54, which measures the pump discharge pressure. Control 40 controls the opening and closing of solenoid valve 44 to control the flow of antifreeze solution to piping system 12. Solenoid valve 44 comprises a two-way solenoid valve, which is normally closed, and is only opened when control 40 detects a pressure drop in piping system 12 below a preset level, as detected by switch 42. Pressure switch 42 is located on the system side of alarm check valve 20 or directly adjacent the system inlet, which monitors the antifreeze solution pressure and signals when the pressure is dropped below a preset value. When the pressure drops below a set point, control 40 opens solenoid valve 44 to allow the flow of antifreeze solution into system 12. When the preset pressure is achieved, the solenoid valve is shut off.

As previously noted, valve 20 comprises a check valve, which maintains the isolation between the water supply and the antifreeze solution while the pressure of the antifreeze solution is maintained. However, once a fire is detected and a sprinkler head is opened, the antifreeze solution will be discharged from the first sprinkler closest to the check valve 20, which opens check valve 20 to allow the water supply to flow into the piping system. In order to limit the delivery of antifreeze solution to the piping system through antifreeze supply system 30, control 40 is in communication with a water flow alarm switch 48, which is in communication with alarm valve 20 at alarm port 20*c* and is actuated when a fire condition occurs due to the flow of water through the valve. Conduit 38 of antifreeze solution delivery system 30 also includes an isolation valve 46*a* to provide a manual shut-off and check valve 46*b* to prevent back flow of antifreeze solution or water into the antifreeze supply system 30.

In addition to control valve 21, which is required to facilitate maintenance of the system and isolation of the antifreeze solution during maintenance and testing, system 10 further includes a system isolation valve 50, which is preferably supervised and facilitates maintenance of the system and isolation of the antifreeze solution during maintenance and testing. The antifreeze solution delivery system also includes a pressure release valve 51 on the antifreeze side of the alarm valve 20, which is preset at a pressure, for example in a range of 165 psi to 185 psi and, optionally, at 175 psi. In this manner, this system can handle the over pressurization due to thermal differentials in the area of the antifreeze piping and system operation.

As previously noted, supervisory switch 42 controls the opening of solenoid valve 44. However, in the case of flow due to a system trip, control 40 maintains the solenoid valve 44 closed regardless of the system pressure. In the case of a fire and flow is established from a sprinkler head assembly, alarm switch 48 sends a signal to control 40, which prevents solenoid valve 44 from opening.

As noted above, control 40 preferably comprises a PLC, which receives input from a number of sources, including supervisory switch 42 and, optionally, from a level switch and alarm 60 for tank 34 and, further, from pressure switch 54. Outputs from control 40 include outputs to pump 36 and solenoid 44. As previously described, control 40 opens solenoid 44 when switch 42 indicates that the pressure in the antifreeze has dropped below the set point. When solenoid 44 is opened, control 40 energizes pump 36 to pump the antifreeze solution from tank 34 through antifreeze supply line or conduit 38 to second inlet 20*d* of valve 20. In addition, control 40 detects the pressure measured by pressure switch 54, which is installed in the pump discharge line, and operates the pump 36 between two set pressures. In addition, as noted above, control 40 is in communication with alarm switch 48 so that when alarm switch 48 detects flow from the water supply through valve 20, which occurs as a result as a sprinkler head opening, control panel 40 will close solenoid valve 44 to stop antifreeze from being delivered to sprinkler piping system 12.

As previously noted, system 10 may include multiple sprinkler piping systems, such as piping system 12'. In the illustrated embodiment, system 12' is connected to water supply 18 through check valve 20' and control valve 21'. System 12' is connected to tank 34 through an antifreeze delivery line 38' with an isolation valve 46*a*', a check valve 46*b*', and solenoid valve 44' similar to system 12. Furthermore, solenoid 44' is similarly controlled by control 40, which is in communication with a supervisory switch 42' provided at valve 20'. In this manner, each piping system 12 may be individually activated to minimize the amount of antifreeze solution that is discharged by the system.

Figure 4:
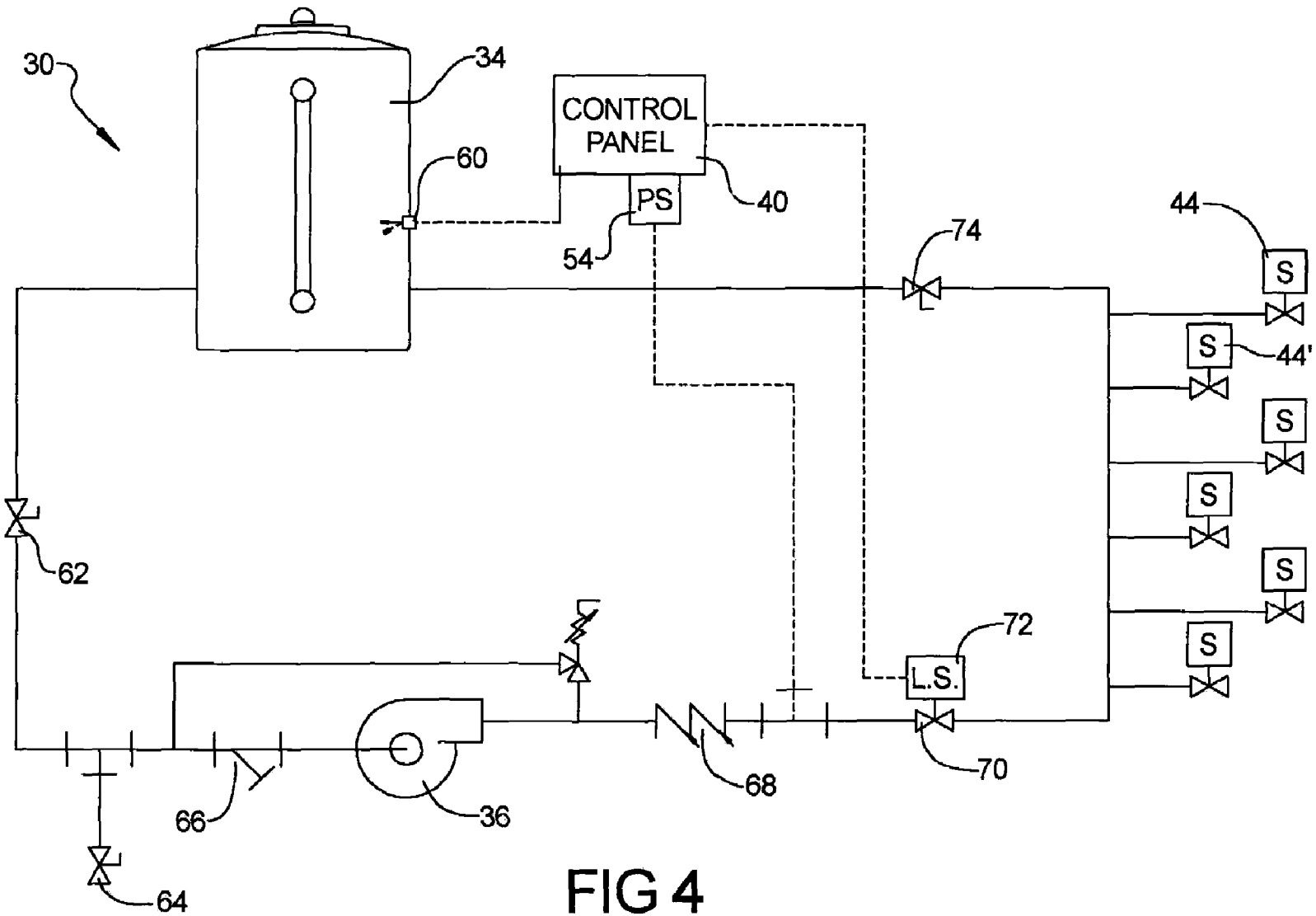
FIG. 4 is a schematic piping and electrical system drawing of the antifreeze supply system of a multiple sprinkler piping system.

Referring to FIG. 4, the numeral 30 generally designates the antifreeze supply system, which is used to maintain the antifreeze solution in the sprinkler piping system 12 (as well as addition systems) at pressures greater than the trip pressure of valve 20 (and also the respective valves of each system). System 30 includes pressure switch 54, which senses the pump discharge pressure and turns on pump 36 when the unit pressure drops to a preset value and then stops the pump when the pressure rises to a higher preset value.

Level switch 60, which is mounted to the storage tank, opens when the premix liquid level is low. When level switch 60 opens, pump 36 is stopped until the tank is filled and switch 60 is reset. As previously mentioned, system 30 may be used to control more than one sprinkler piping system. In the illustrated embodiment, system 30 is configured to control six sprinkler piping systems, with each of the systems connected to system 30 through a normally closed solenoid valve 44 (only 44, 44' labeled). The pressure supervisory switch 42 and flow alarm switch 48 for each system are connected to the control 40. When the system pressure of each system reaches the system set point, the respective system's pressure supervisory switch opens and control 40 closes that solenoid valve. Where a pressure drop is detected by supervisory pressure switch 42, pump 36 is operated. Pressure switch 42, which monitors the pressure in the antifreeze delivery line, controls the pump operation. When the pressure drops, the pump 36 will be turned on until the pressure rises above the set level. As noted above, in the case of flow during a system trip, that system's flow alarm pressure switch 48 opens and control 40 prevents that particular system's solenoid valve 44 from opening, regardless of system pressure. Control 40 may provide for two modes of operation—a manual mode and an automatic mode. The manual mode allows a user to operate the pump 36 by means of a switch (not shown) regardless of the electrical control status. On the other hand, automatic operation uses the unit pressure switch 54 to operate the pump based on unit pressure. The flow to each system is controlled by that system's pressure switch (42, 42') and flow alarm switch (48, 48'). Optionally, a sight glass is mounted to storage tank 34, which allows visual indication of the antifreeze level. The pump suction line includes a tank discharge valve 62, a supply isolation valve 64, and a Y-strainer 66. The pump discharge line includes a check valve 68 and a system isolation valve 70 with a supervisory switch 72, which together provide isolation of the solenoid valves from the pump discharge line. The return line also optionally includes a tank fill isolation valve 74.

Figure 5A:
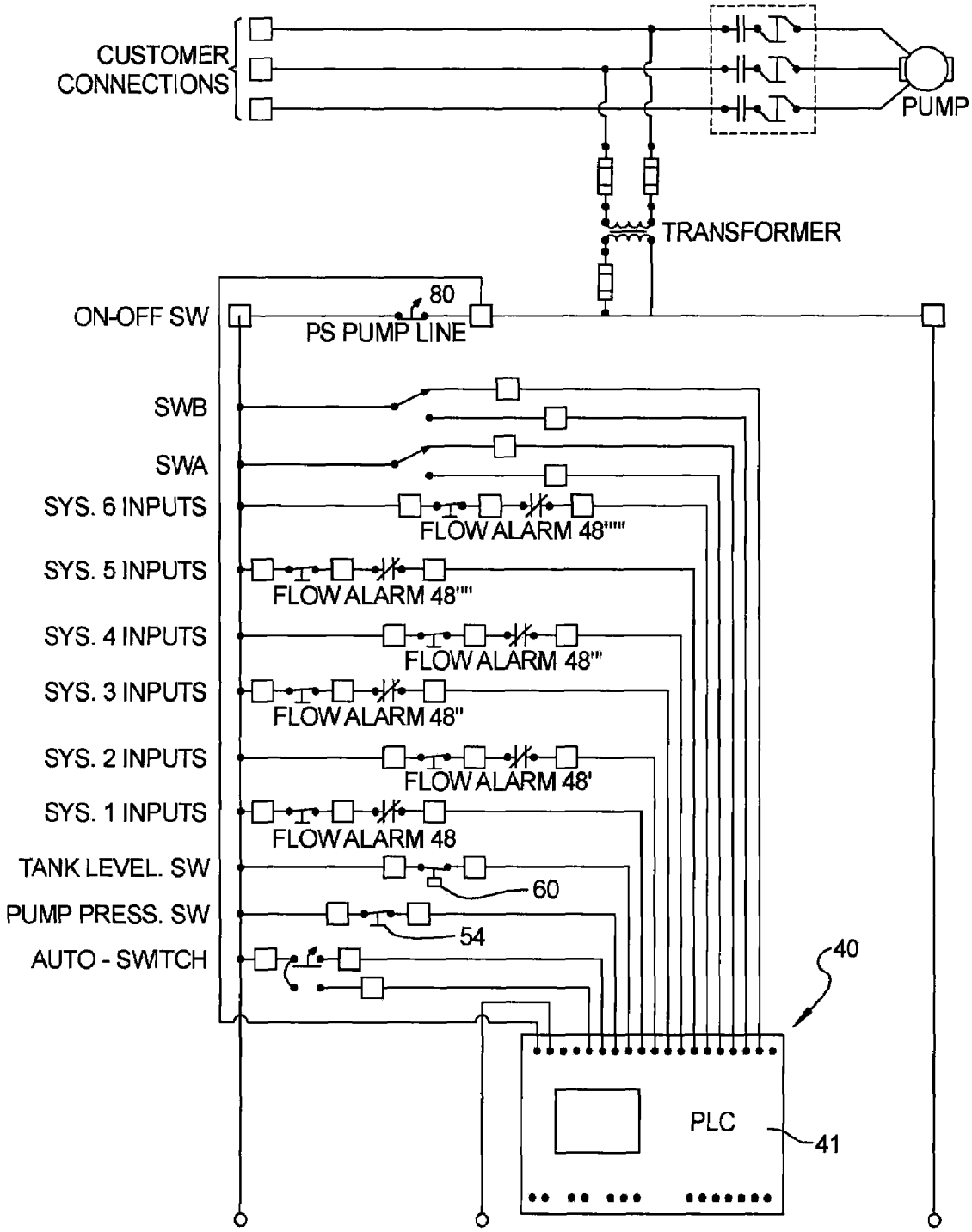
FIG. 5 is a schematic of the control panel and electrical system for the antifreeze supply system for a multiple sprinkler piping system.
Figure 5B:
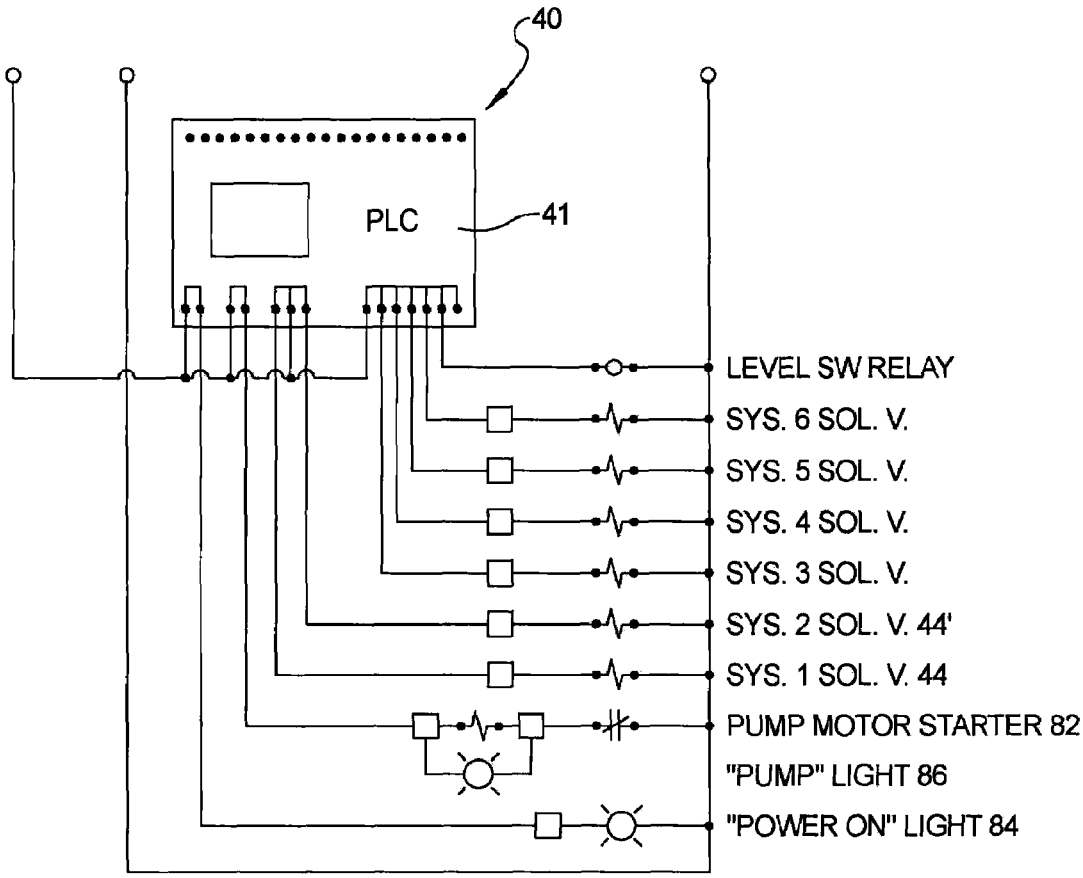
Figure 5C:
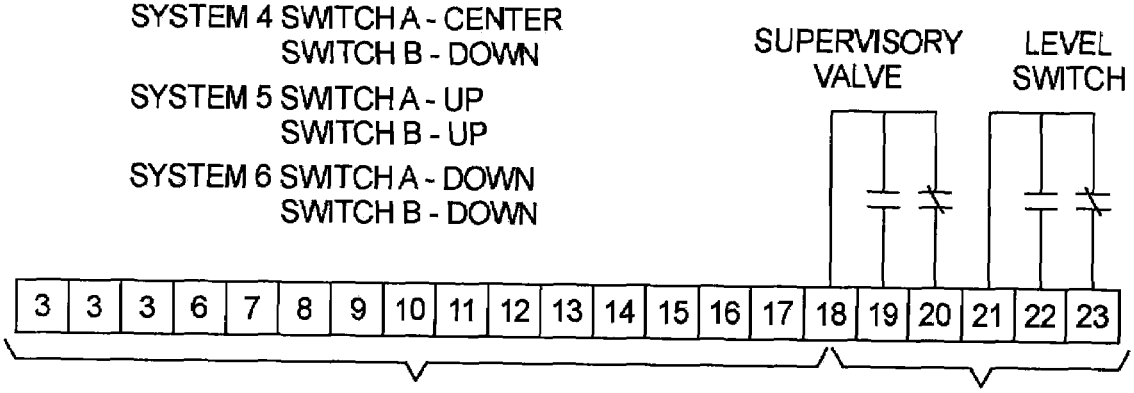

Referring to FIG. 5, control 40, as previously noted, preferably comprises a PLC. In the illustrated embodiment, control 40 is configured for controlling the various solenoid valves (44, 44', etc.) of six sprinkler piping systems. Control 40, therefore, receives input from the flow alarm and pressure switches 48 of each system and, further, from the tank level switch 60 and pump unit pressure switch 54 of the antifreeze solution supply system 30. Control 40 also preferably includes an on/off switch 80. The outputs of control 40 include outputs to the respective solenoid valves 44, 44', etc. and, further, to the pump motor starter 82. Optionally, control 40 may be configured for a manual mode of operation and include inputs from switches for system selection. Other outputs may include a system power-on light 84 and a pump light 86 to indicate when the pump is running.

Figure 6:
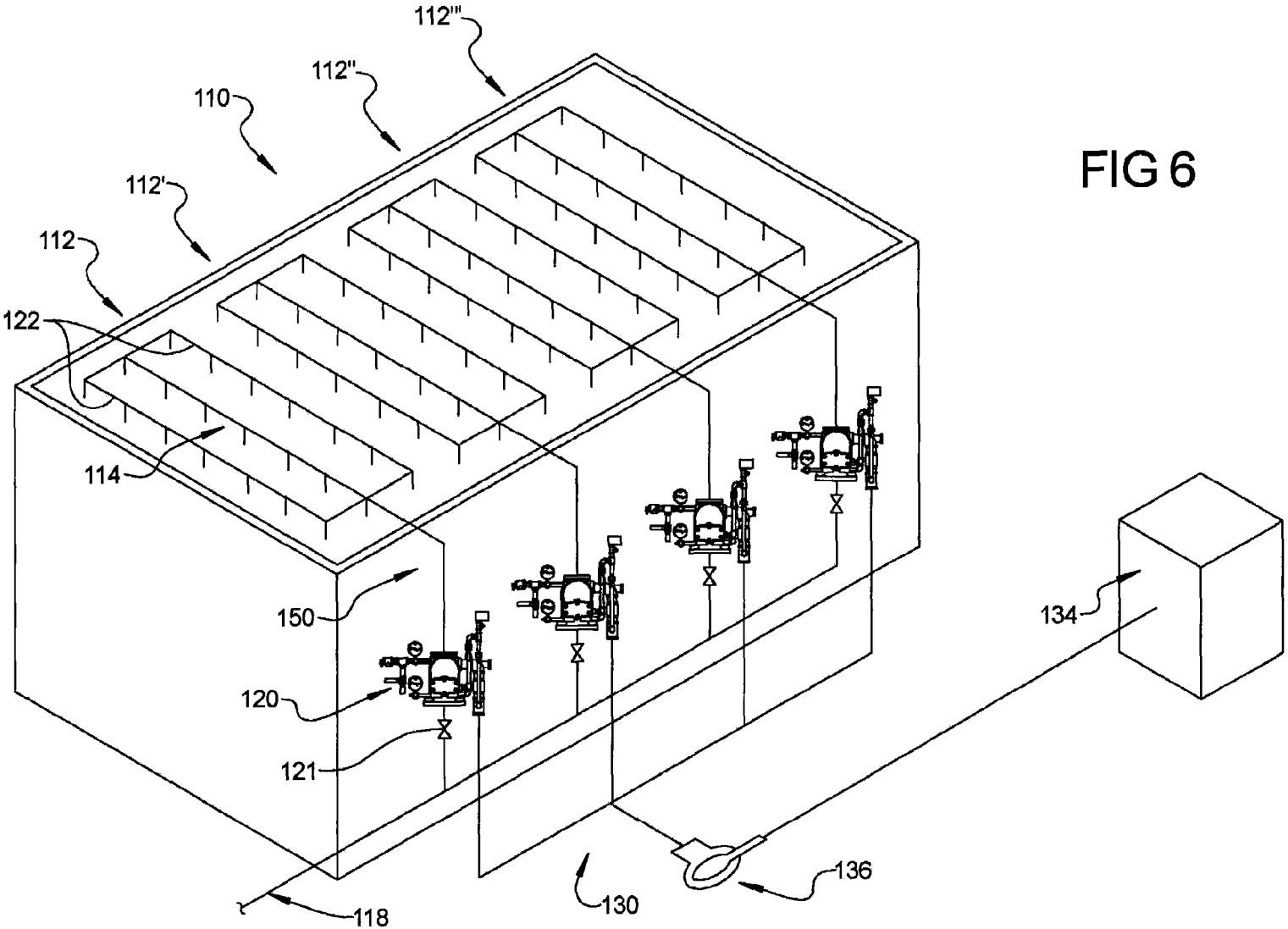
FIG. 6 is a schematic piping drawing of a second embodiment of the early suppression fast response fire protection system of the present invention incorporating sprinkler piping system in a grid configuration.

Referring to FIG. 6, another embodiment of the ESFR fire protection system 110 of the present invention includes four plurality of sprinkler piping systems 112, 112', 112", and 112'", which have a grid configuration. It should be understood that the number of sprinkler piping systems may be increased or decreased as needed to accommodate the area being controlled. Systems 112, 112', 112", and 112'" are all delivered antifreeze solution from a common antifreeze solution supply system 130, and water from a common water supply system 118, but each system is independently controlled by a check valve 120 and a control valve 121. For ease of reference, reference hereinafter will be made to system 112.

System 112 includes a central main line 114 and a pair of U-shaped branch lines 122, which form the grid configuration. As noted, each system includes a check valve 120 and a control valve 121 and, further, an isolation valve 150 similar to the previous embodiment. A grid-type configuration is particularly suitable for high storage applications so that water supplied to each open sprinkler head assembly will flow from multiple directions. For further details of antifreeze solution supply system 130, valves 120, 121, and 150, reference is made to the previous embodiment.

Figure 7:
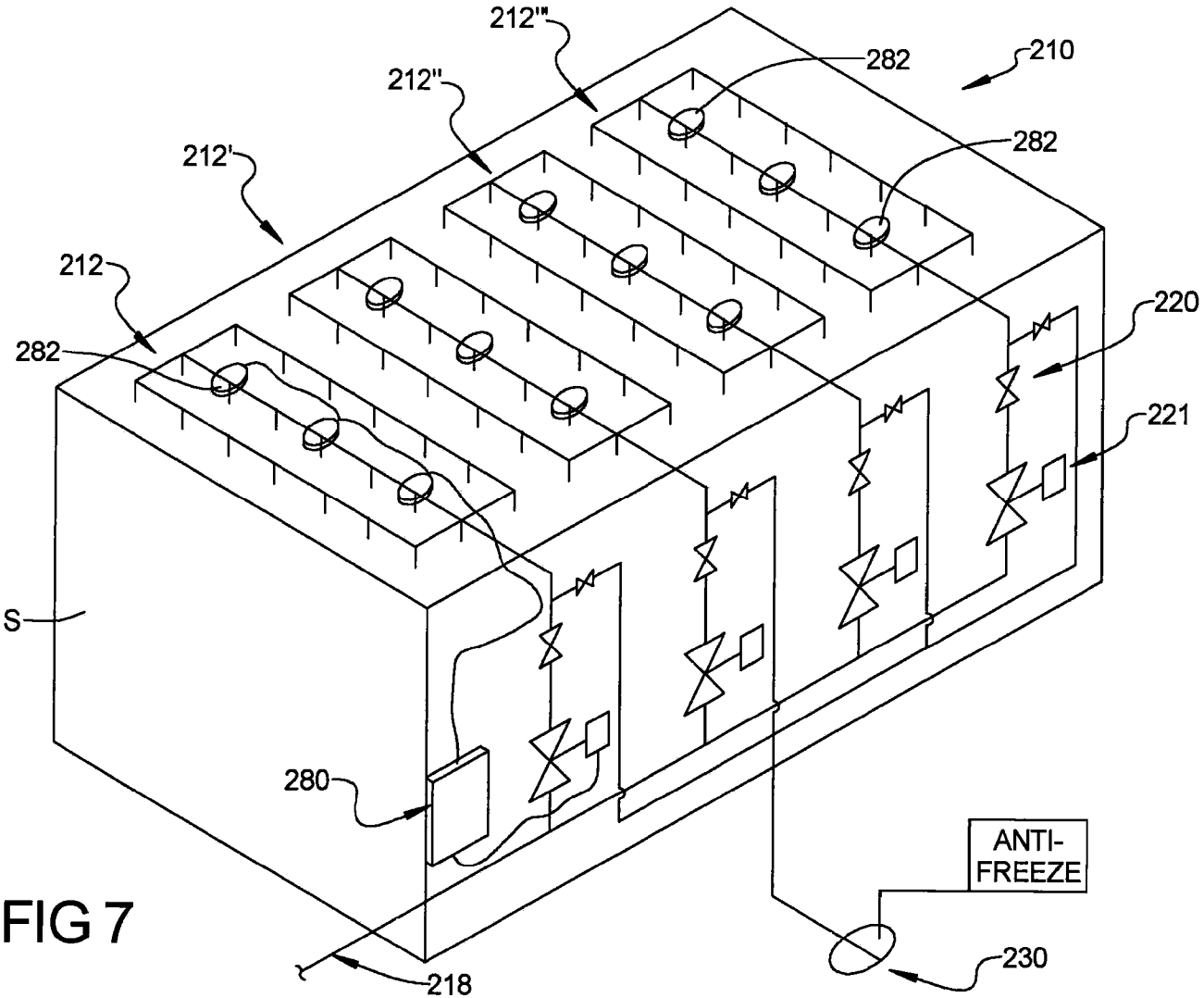
FIG. 7 is a schematic view of a preaction fire protection system incorporating the antifreeze supply system of the present invention.
Figure 10:
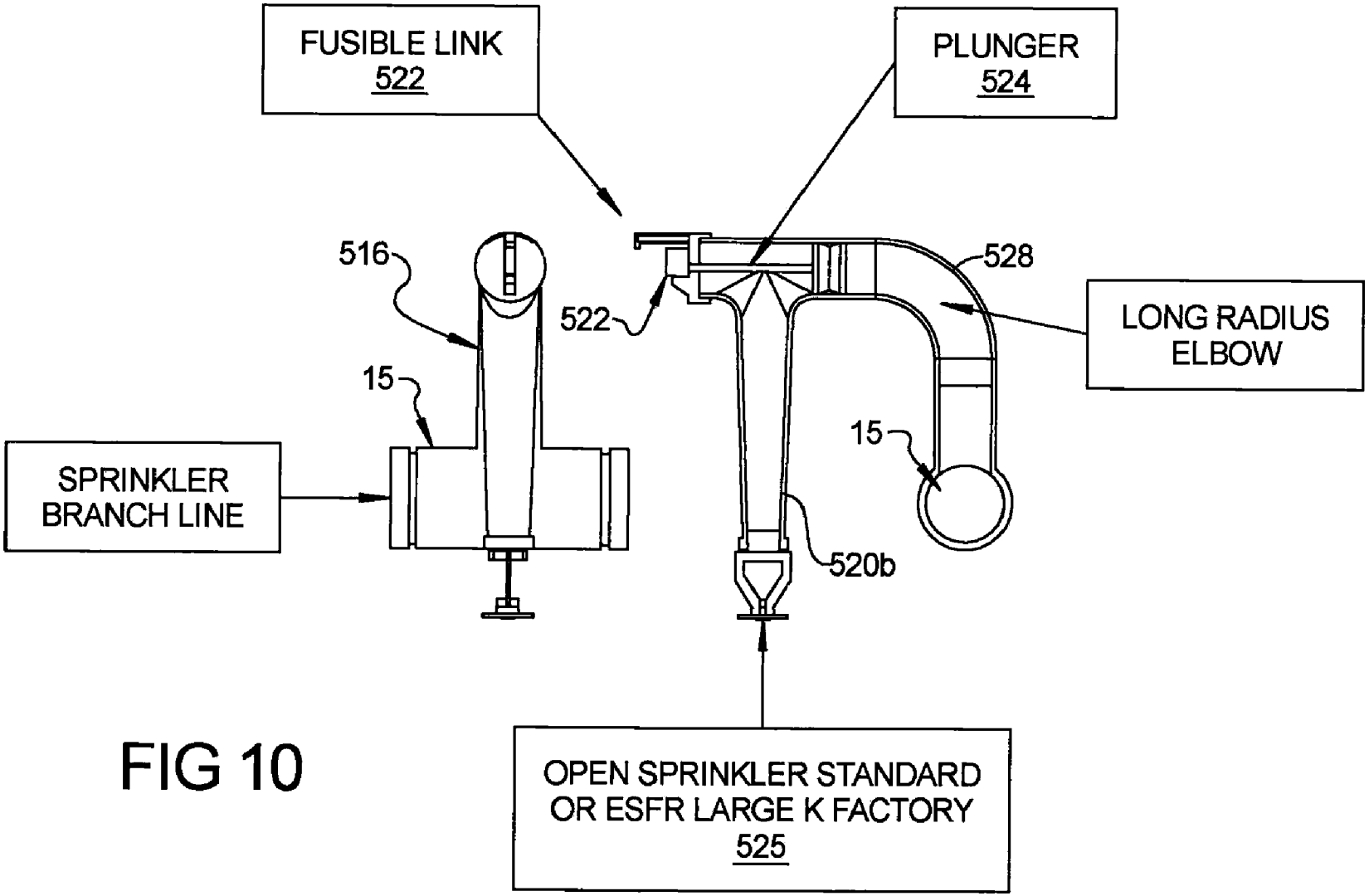
FIG. 10 is a side elevation view of an improved sprinkler head assembly with a remote trigger assembly shown mounted to a branch line.
Figure 11:
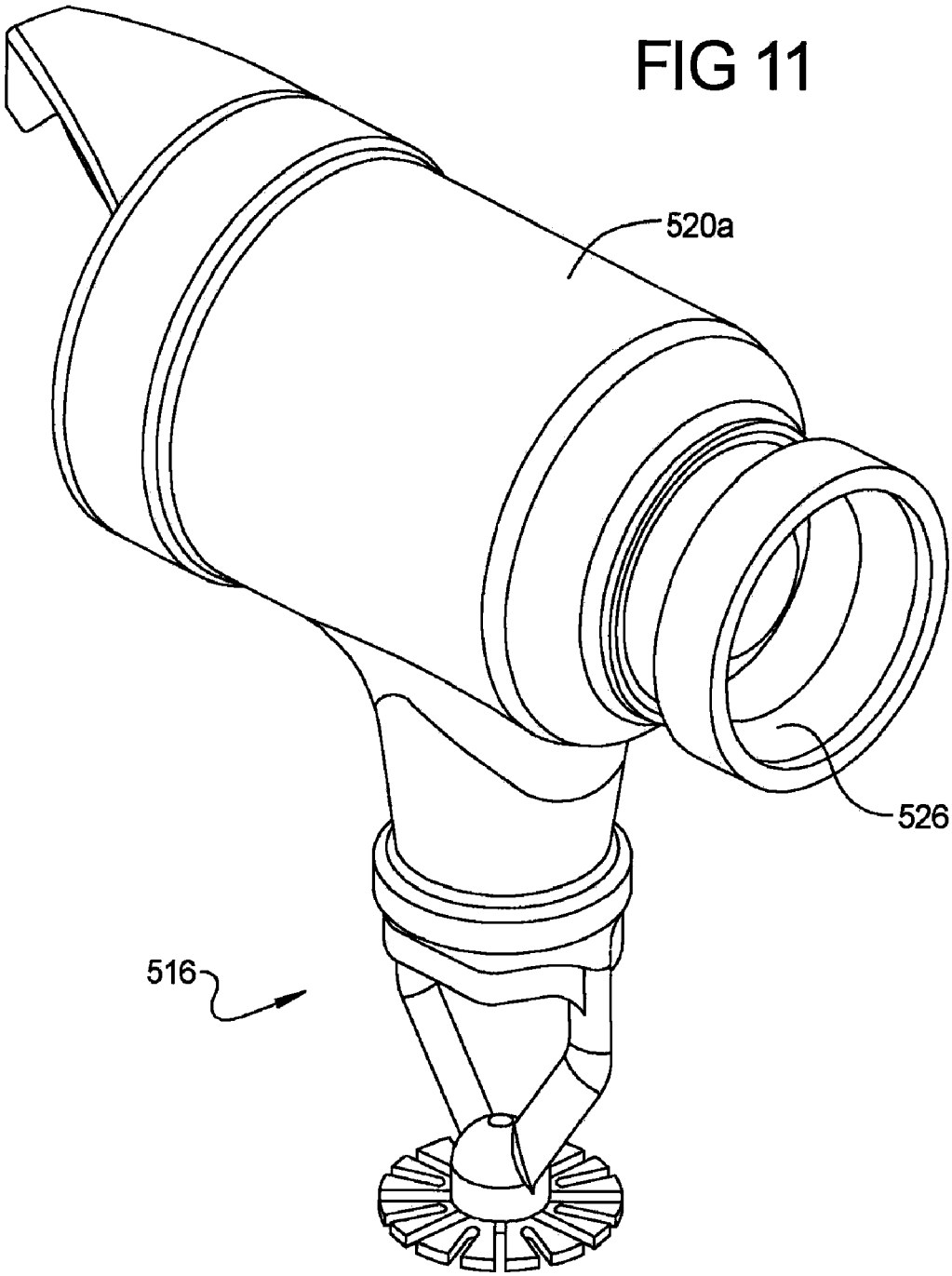
FIG. 11 is an enlarged perspective view of the sprinkler head assembly of FIG. 10.
Figure 12:
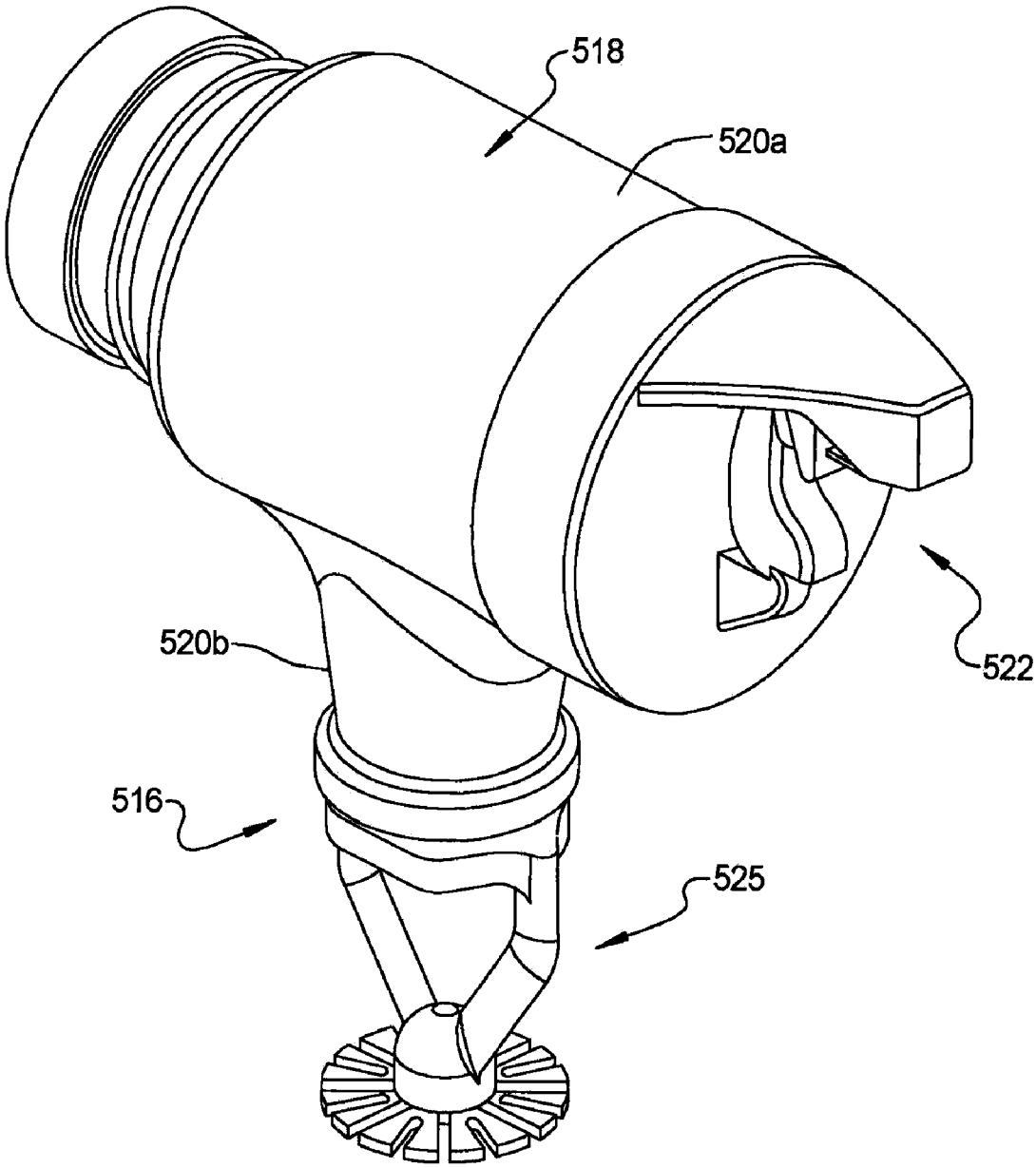
FIG. 12 is second enlarged perspective view of the sprinkler head assembly of FIG. 10.
Figure 13:
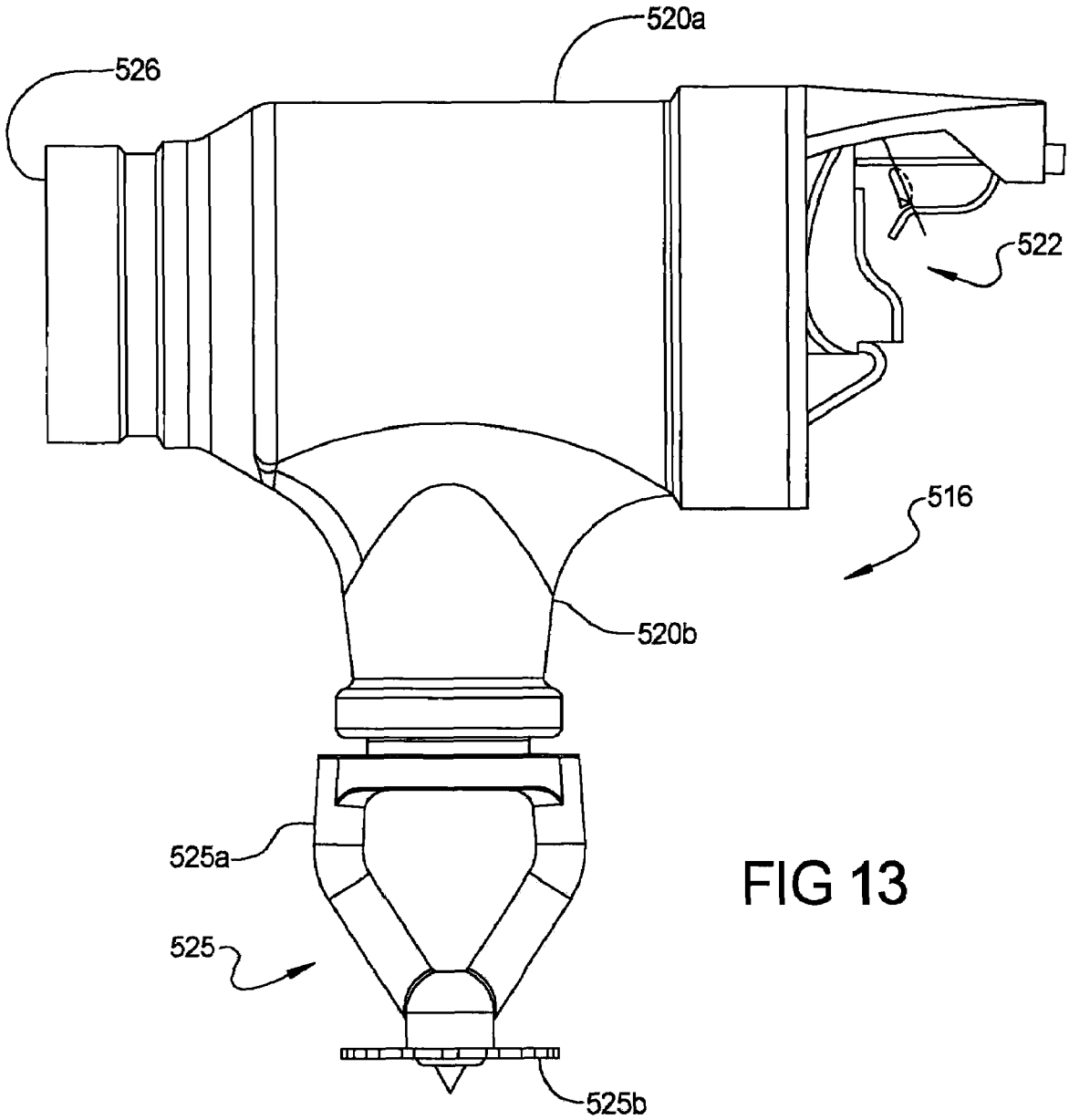
FIG. 13 is a side elevation view of the sprinkler head assembly of FIG. 12.
Figure 14:
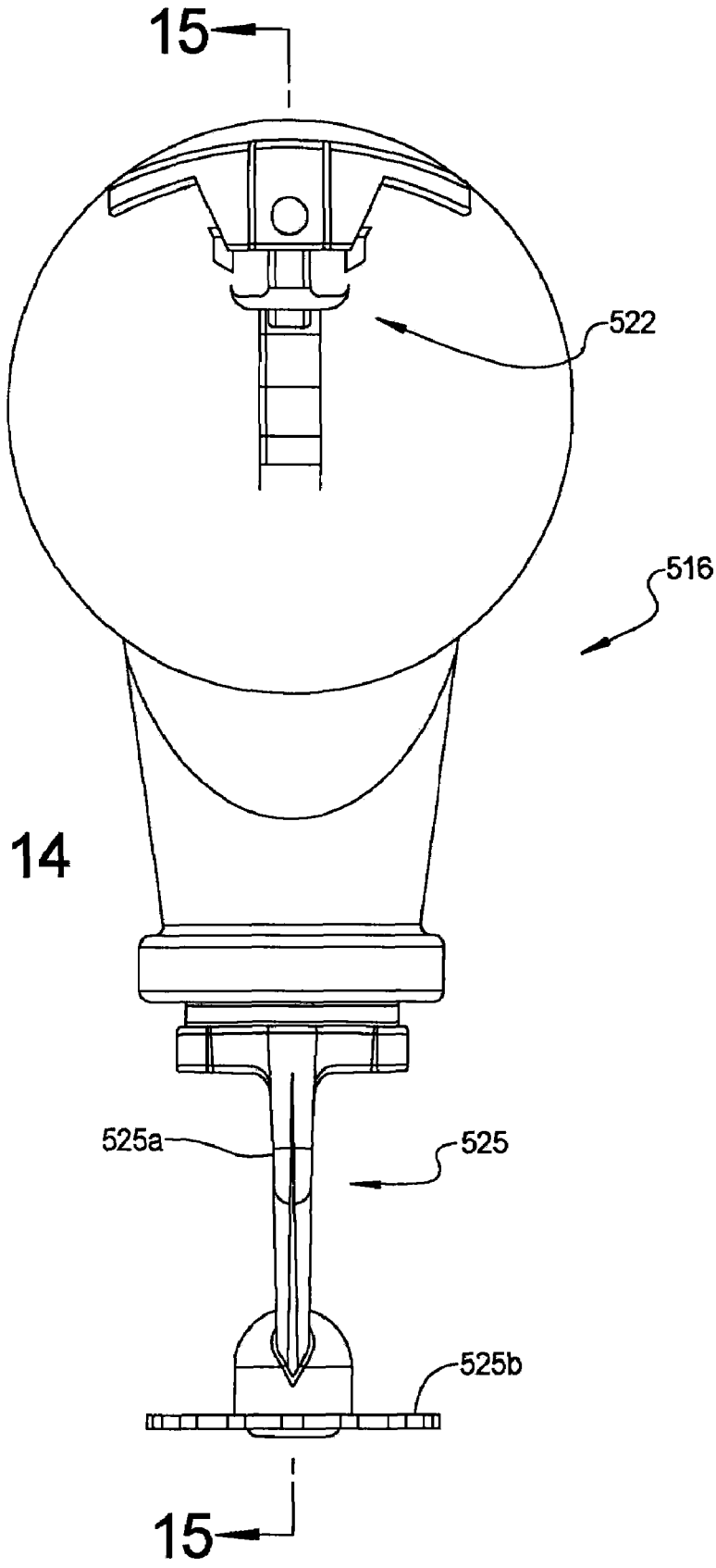
FIG. 14 is an end view of the sprinkler head assembly of FIG. 13.

Referring to FIG. 7, the numeral 210 generally designates an ESFR fire protection system of the present invention that incorporates a preaction system. Similar to the previous embodiment, system 210 includes a plurality of sprinkler piping systems 212, 212', 212", and 212'", with each system supplied antifreeze solution by a common antifreeze solution supply system 230 and each supplied water from a common water supply system 218. For details of system 230, reference is made to the previous embodiments.

Also similar to the previous embodiments, each sprinkler piping system includes associated therewith a check valve 220 and a control valve 221. Check valves 220 isolate the antifreeze solution in the respective sprinkler piping systems from the water supply in a similar manner to the previous embodiments.

Control valves 221 on the other hand are controlled by a control panel 280, which is in communication with fire detectors located in storage area S. Preferably, each sprinkler piping system has one or more fire detectors 282 associated therewith so that the control valves may be independently opened and, further, opened when the fire detectors 282 associated with a sprinkler piping system are actuated. Therefore, if the fire detectors of more than one sprinkler piping system are actuated, then control panel 280 will open the control valves 221 associated with each sprinkler piping system 212 that has an actuated fire detector. In this manner, water is not delivered to the respective check valves until a fire condition is detected, which minimizes the risk of water damage in a non-fire condition.

Referring to FIG. 8, the numeral 310 generally designates an ESFR fire protection system of the present invention that incorporates air and antifreeze supervision. In the illustrated embodiment, system 310 includes a pair of sprinkler piping systems 312 and 312', with each sprinkler piping system being configured in a grid-piping configuration similar to system 110, though with additional branch lines provided. Each sprinkler piping system includes a check valve 320, 320' and a control valve 321, 321'. Furthermore, each sprinkler piping system 312, 312' is supplied antifreeze solution from an antifreeze solution delivery or supply system 330, similar to the previous embodiments.

In the illustrated embodiment, control valves 321 comprise preaction deluge valves similar to the valve described in reference to co-pending application entitled FIRE PROTECTION SYSTEM, Ser. No. 10/438,726, filed May 15, 2003, which is commonly assigned to The Viking Corporation of Hastings, Mich. , which is incorporated by reference herein in its entirety. In this embodiment, the piping between check valve 320 and 321 is supervised by air, preferably a low-pressure air. In addition, similar to the previous embodiment, valves 321 are controlled by a control panel 380, which is in communication with fire detectors 382 and further supervisory air switches (not shown) that monitor the air pressure between the check valves and control valves of each sprinkler piping system. Control panel 380 is configured to open the control valve when a fire detector of a sprinkler piping system detects a fire and when a supervisory pressure switch detects a pressure drop for that same sprinkler piping system. Further, as described in the referenced application, control panel 380 is configured so that during a normal powered state, the control valves 321 will only be opened when both conditions noted above occur. However, in a loss-of-AC power condition, control panel 380 is configured to open the respective control valves when a fire is detected by the fire detectors 382 of that sprinkler piping system.

Antifreeze solution supply system 330 operates in a similar manner to system 30 to supply antifreeze solution and maintains the pressure of the antifreeze solution in the sprinkler piping system so that the combination of the check valve to isolate the antifreeze solution and the low pressure supervisory air and deluge pre-action control valve to isolate the sprinkler water supply from the sprinkler piping system is controlled by a combination of air supervisory devices and a detection system, which makes for precise control of the suppression system and control of water entering the antifreeze solution in the cold storage being protected.

As described in the referenced application, valve 321 is configured and controlled so that when the pressure in the supervisory air drops, which occurs when the check valves open due to a sprinkler head assembly being triggered in a fire condition, valve 321 is opened to allow the water supply to flow through to the check valve 320 for delivery to the respective sprinkler piping system. However, if the check valve 320 opens as a result of a broken sprinkler, the deluge valve control system will not open the valve 321. The failsafe feature allows the system deluge valve to remain closed if no fire is detected from the detection system. However, if the sprinkler breaks or piping system 312 is damaged and no fire is detected by the detection system, the system is configured so that it will only discharge antifreeze solution and not allow water to enter the system. However, if a fire is detected by the detection system, the deluge valve 321 will open prior to the sprinklers and will pressurize the system for extinguishment of the fire. Preferably, the antifreeze solution supply system control is in communication with air supervisory switches, which monitor the air pressure between the check valves and the control valves so that if a non-fire condition occurs but there is a pressure drop due to a sprinkler opening, the control will shut of the supply of antifreeze solution. The control of the antifreeze supply system may also be in communication with flow detectors of the control valves so that the antifreeze solution is no longer supplied when the control valves 321 open.

Referring to FIG. 9, the numeral 410 generally designates another ESFR fire protection system of the present invention that incorporates air supervision. In the illustrated embodiment, system 410 includes a plurality of sprinkler piping systems 412, 412', 412", and 412''' with each sprinkler piping system being configured in a grid-piping configuration similar to system 110. Each sprinkler piping system includes a check valve (e.g. 420) and a control valve (e.g. 321). Furthermore, each sprinkler piping system 412, 412', 412", and 412''' is supervised with air. The control valves are control by a control panel 480, which is in communication with supervisory air switches that detect the pressure in each of the sprinkler piping systems and the fire detectors 482 associate with each of the systems 412, 412', 412", and 412''', which allows the system to be configured as a preaction system, as previously described and also as FAILSAFE preaction system, also previously described herein and in the referenced application.

Referring to FIGS. 10-15, the numeral 516 generally designates a top or side mounted dry pendent sprinkler assembly that may be suitable for use in any one of the systems described herein. Sprinkler assembly 516 includes a generally T-shaped body 518 with an upper transverse portion 520*a* that houses a fusible link assembly 522 and a plunger 524. Mounted to the lower portion 520*b* of body 518 is an open sprinkler 525 with a frame 525*a* (FIG. 13) and deflector 525*b* mounted to frame 525*a*. One end 526 of the upper transverse portion 520*b* is adapted for mounting to an extension pipe 528, such as a long radius pipe, which in turn is mounted so that it is in fluid communication with a branch line of the sprinkler piping system, such as branch line 15.

Figure 15:
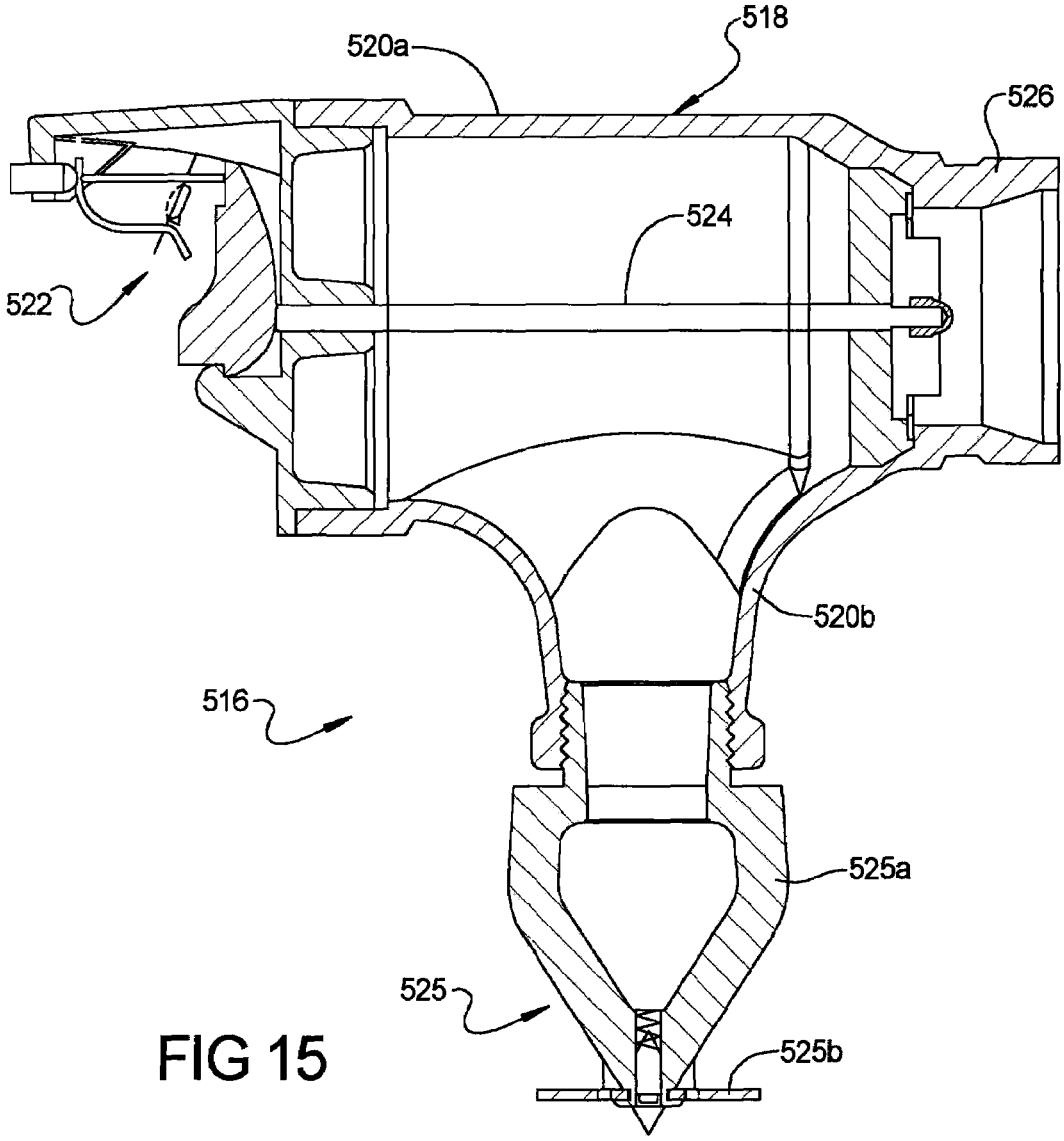
FIG. 15 is a cross-section view taken along line XV-XV of FIG. 14.

When mounted to a branch line, sprinkler assembly 516 may protrude down in the pendent position, isolating the supervisory medium from the sprinkler and allows proper and complete drainage of the system. For this application, the complete sprinkler assembly is installed in the cold area. As best seen in FIG. 15, fusible link 522 is mounted near the top of the sprinkler assembly to hold back supervisory air or antifreeze. Fusible link 522 is connected to plunger 524, which seals the supervisory medium. Extension pipe 528 (FIG. 10) is configured so that open sprinkler 525 points downward in a pendent position just below the sprinkler system branch piping. This allows the fusible link to be installed as high as possible near the ceiling rather than below the system piping. The closer to the ceiling the quicker the operation of the sprinkler in fire condition. Also with faster operation of system less sprinklers are required for control of the fire. With top mounted fused dry pipe sprinklers the channel from the plunger to the sprinkler is an open conduit to provide a larger flow capacity sprinkler and can provide large and small K factor sprinklers of a standard configuration with open, non-fused seats.

While several forms of the invention have been shown and described, other forms will now be apparent to those skilled in the art. As would be understood, the present invention provides an early suppression fast response sprinkler (ESFR) technology, which typically requires a wet-pipe system type application, that can now be applied using preaction fire protection technology that causes less damage due to water discharge and can prevent undesired freezing of piping system in cold storage areas. Single system piping system or multiple sections of system can be applied using antifreeze or air as system supervisory system or a combination of air and antifreeze. With the controllable preaction system, multiple areas of system supervision are capable, which allows more rapid transit of water to sprinkler and less damage to complete system in case of fire or water entering the system piping. The combination of a detection system and sprinklers allow for better control of water supply operation, which will prevent unwanted water flow when not required. With allowance of smaller system coverage, using preaction technology quicker flow of water to sprinkler is capable, as required by ESFR protection, and when fire water is required only the effected area of fire is effected by water contamination of piping system and potentially can freeze.

The combination of air and antifreeze, applied using the preaction fire protection system of the present invention, makes possible single and double interlock protection to prevent costly water flow when no fire is present. This combines supervision of the piping system and the detection system for operation of water supply only when a fire occurs. The combination of antifreeze and air supervision of piping system also allows for a FAILSAFE preaction system application. In case of a power outage for an extended period of time, the system can revert to a dry system in combination with the wet antifreeze supervision. Rapid detection systems combined with the preaction deluge sprinkler system also allow for rapid fill of the piping system and the system to be considered as a wet pipe system, as required for ESFR fire protection technology. The heat detection system may be fixed temperature or rate of rise, electric or pneumatic controlled. For electric controlled systems, a releasing control panel connected to the control solenoid valves of the preaction valve system is preferred. With an air supervised system piping, upright or dry pendent sprinklers may be used to prevent freezing when system is drained down. Antifreeze of food grade solution in combination with wetting agent provides extinguishing characteristics similar or better than water. The use of propylene glycol, water and wetting agent or Class A foam solutions may be used and may be used in combination, which provides an extinguishing solution that will not freeze under normal conditions. As would be understood, the solution mixture is determined by lowest temperature of protected area.

Therefore, it will be understood that the embodiments shown in the drawings and described above are merely for illustrative purposes, and are not intended to limit the scope of the invention, which is defined by the claims, which follow as interpreted under the principles of patent law including the doctrine of equivalents.

We claim:

1. An fire protection system comprising:

sprinkler piping system with at least one sprinkler head assembly;

a water supply system;

a check valve having a water supply inlet and an outlet, said outlet of said check valve in fluid communication with said sprinkler piping system, and said water supply inlet in selective fluid communication with said water supply system;

a fire suppression solution supply system in fluid communication with said sprinkler piping system, said check valve isolating said fire suppression solution from said water supply unless a fire condition occurs;

a pressure detector detecting the pressure of the fire suppression solution in said sprinkler piping system;

a flow detector detecting the flow of water from said water supply system; and a control in communication with said flow detector and said pressure detector, said control controlling the flow of said fire suppression solution to said sprinkler piping system and maintaining the pressure of said fire suppression solution in said sprinkler piping system unless said flow detector detects the flow of water from said water supply system in which case said control stops the flow of fire suppression solution to said sprinkler piping system to limit the discharge of fire suppression solution from the fire protection system.

2. A fire protection system according to claim 1, wherein said check valve includes a fire suppression supply inlet, said fire suppression solution supply system in fluid communication with said fire suppression supply inlet of said check valve.

3. A fire protection system according to claim 1, wherein said check valve includes an alarm port, said flow detector detects the flow of water through said check valve through said alarm port.

4. A fire protection system according to claim 1, further comprising:

a second sprinkler piping system with at least one sprinkler head assembly;

a second check valve having a water supply inlet and an outlet, said outlet of said second check valve in fluid communication with said second sprinkler piping system, and said water supply inlet of said second check valve in fluid communication with said water supply system;

said fire suppression solution supply system in fluid communication with said second sprinkler piping system, said second check valve isolating said fire suppression solution in the second sprinkler piping system unless a fire condition occurs;

a second pressure detector detecting the pressure of the fire suppression solution in said second sprinkler piping system;

a second flow detector detecting the flow of water through said second check valve from said inlet to said outlet of said second check valve when said second check valve is opened; and said control in communication with said second flow detector and said second pressure detector, said control controlling the flow of fire suppression system to said second sprinkler piping and maintaining the pressure of said fire suppression solution in said second sprinkler piping system unless said second flow detector detects the flow of water through said second check valve from said inlet to said outlet of said second check valve in which case said control stops the flow of fire suppression solution to said second sprinkler piping system to limit the discharge of fire suppression solution from the fire protection system.

5. A fire protection system according to claim 4, wherein at least one of said sprinkler piping systems comprises a tree configuration with a center or side feed main line and at least two branch lines extending from said center main line.

6. A fire protection system according to claim 1, further comprising a control valve in fluid communication with said water supply inlet of said check valve.

7. A fire protection system according to claim 6, wherein said control valve isolates said water supply from said check valve and said sprinkler piping system until a fire is detected.

8. A fire protection system according to claim 7, wherein said control valve includes an inlet and an outlet, said outlet of said control valve in fluid communication with said inlet of said check valve through a conduit, said conduit filled with air.

9. A fire protection system according to claim 8, further comprising an air pressure monitoring system monitoring the air pressure in said conduit, said control in communication with said air pressure monitoring system.

10. A fire protection system according to claim 9, further comprising at least one fire detector and a control system, said control system in communication with said fire detector, said air pressure monitoring system, and said control valve, said control system actuating said control valve to open in response to said detector detecting a fire condition and said air pressuring monitoring system detecting a pressure drop in said conduit.

11. A fire protection system according to claim 7, further comprising at least one fire detector and a control system, said control system in communication with said fire detector and actuating said control valve to open when said fire detector detects a fire condition.

12. A fire protection system comprising:

a plurality of sprinkler piping system with each sprinkler piping system having at least one sprinkler head assembly;

a water supply system;

a check valve for each sprinkler piping system, each check valve having a water supply inlet and an outlet, each of said outlets of said check valves in fluid communication with one of said sprinkler piping systems, and each said water supply inlet in fluid communication with said water supply system;

a fire suppression solution supply system in fluid communication with each of said sprinkler piping systems, each of said check valves isolating said fire suppression solution in said one of said sprinkler piping system from said water supply unless a fire condition occurs;

pressure detectors detecting the pressure of the fire suppression solution in each of said sprinkler piping systems;

a flow detector associated with each of said sprinkler piping systems for detecting the flow of water from said water supply system to each of said sprinkler piping systems; and a control in communication with said flow detectors and said pressure detectors, said control controlling the flow of fire suppression solution to each of said sprinkler piping systems and maintaining the pressure of said fire suppression solution in each of said sprinkler piping systems unless a flow detector associated with a respective sprinkler piping system detects the flow of water from said water supply system in which case said control stops the flow of fire suppression solution to said respective sprinkler piping system to limit discharge of fire suppression solution from the fire protection system.

13. A fire protection system according to claim 12, wherein said sprinkler head assemblies each have a K-factor in a range of 11 to 50.

14. A fire protection system according to claim 12, wherein each of said sprinkler head assemblies comprises a pendent or upright sprinkler.

15. A fire protection system according to claim 12, further comprising a plurality of control valves each having an inlet in fluid communication with said water supply system and an outlet in fluid communication with one of the sprinkler piping system.

16. A fire protection system according to claim 15, further comprising at least one fire detector, said control valves controlling the flow of water from said water supply to said check valves, said control valves opening flow to the water supply to said check valve when said at least one fire detector detects a fire.

17. A fire protection system according to claim 15, wherein each of said control valves comprises a preaction deluge valve.

18. A fire protection system according to claim 12, wherein each of said sprinkler piping systems comprises a tree configuration with a central or side feed main line and at least two branch lines extending off said main line.

19. A fire protection system according to claim 12, wherein each of said sprinkler piping systems comprises a grid configuration.

20. A fire protection system comprising:

a first sprinkler piping system with at least one sprinkler head assembly;

a second sprinkler piping system with at least one sprinkler head assembly;

a water supply system;

a first check valve having a water supply inlet and an outlet, said outlet of said check valve in fluid communication with said first sprinkler piping system, and said water supply inlet in fluid communication with said water supply system;

a second check valve having a water supply inlet and an outlet, said outlet of said second check valve in fluid communication with said second sprinkler piping system, and said water supply inlet of said second check valve in fluid communication with said water supply system;

a first control valve having an inlet in fluid communication with said water supply system and an outlet in fluid communication with said inlet of said first check valve;

a second control valve having an inlet in fluid communication with said water supply system and an outlet in fluid communication with said inlet of said second check valve;

an air pressure supply system in fluid communication with said first sprinkler piping system and said second sprinkler piping system and supplying air to said sprinkler piping system;

a first air pressure detector detecting the pressure of the air in said first sprinkler piping system;

a second pressure detector detecting the pressure of air in said second sprinkler piping system;

a first fire detector associated with said first sprinkler piping system;

a second fire detector associated with said second sprinkler piping system; and a control system in communication with said control valves, said fire detectors, and said air pressure detectors, said control system actuating said first control valve to open when said fire detector associated with said first sprinkler piping system detects a fire and said first air pressure detector detects a drop in the air in said first piping system, and said control system actuating said second control valve to open when said second fire detector detects a fire and said second air pressure detects a pressure drop in the air in said second piping system.

21. A fire protection system according to claim 20, wherein in each of said first sprinkler piping system and said second sprinkler piping includes a plurality of said sprinkler head assemblies.

22. A fire protection system according to claim 21, wherein each of said sprinkler head assemblies has a K-factor in a range of 15 to 30.

23. A fire protection system according to claim 22, wherein each of said sprinkler head assemblies comprises a pendent or upright sprinkler head assembly.

24. A fire suppression system comprising:

a sprinkler piping system having at least one sprinkler head assembly;

a water supply system;

a check valve having a water supply inlet and an outlet in fluid communication with said sprinkler piping system;

a deluge valve in selective fluid communication with said inlet of said check valve, and said deluge valve for controlling flow of water to said sprinkler piping system;

at least one fire detector for detecting a fire condition;

a fire suppression solution supply system in fluid communication with said sprinkler piping system, said check valve isolating said fire suppression solution from said water supply system unless a fire condition occurs and said deluge valve is opened;

a pressure detector detecting the pressure of the fire suppression solution in said sprinkler piping system;

a control in communication with said pressure detector, and said control supplying said fire suppression solution to said sprinkler piping system and maintaining the pressure of said fire suppression solution in said sprinkler piping system; and a control system having a pneumatic actuator adapted to monitor the pressure between said check valve and said deluge valve, said control system in communication with said fire detector, a source of power, and said deluge valve, said control system adapted to actuate said deluge valve to open in response to said fire detector detecting a fire condition and a low pressure condition between said check valve and said deluge valve, said control system actuating said deluge valve also when said pneumatic actuator detects a drop in pressure between said check valve and said deluge valve and when said control system experiences a loss of power from said source of power, and said control stopping the flow of fire suppression solution to said sprinkler piping system to limit the discharge of fire suppression solution from the fire protection system when said control detects one of (a) drop of pressure between said check valve and said deluge valve and (b) flow of water through said deluge valve.

25. A fire suppression system according to claim 24, wherein said control stops the flow of fire suppression solution to said sprinkler piping system when said control detects flow of water through said deluge valve.

26. A fire protection system according to claim 1, wherein said fire suppression solution supply system comprises an antifreeze solution supply system.

27. A fire protection system according to claim 12, wherein said fire suppression solution supply system comprises an antifreeze solution supply system.

28. A fire protection system according to claim 24, wherein said fire suppression solution supply system comprises an antifreeze solution supply system.

* * * * *

UNITED STATES PATENT AND TRADEMARK OFFICE

CERTIFICATE OF CORRECTION

PATENT NO. : 7,383,892 B2
APPLICATION NO. : 10/935255
DATED : June 10, 2008
INVENTOR(S) : Eldon D. Jackson It is certified that error appears in the above-identified patent and that said Letters Patent is hereby corrected as shown below:

Col. 3, line 47, delete "ESER" and insert --ESFR-- therefor.
Col. 8, line 33, delete "form" and insert --from-- therefor.
Col. 10, line 62, delete "addition" and insert --additional-- therefor.
Col. 13, line 43, delete the first occurrence of "of" and insert --off-- therefor.
Col. 13, line 58, delete the first occurrence of "control" and insert --controlled-- therefor.
Col. 15, line 26 (claim 1), delete "An" and insert --A-- therefor.

Signed and Sealed this

Sixteenth Day of September, 2008

JON W. DUDAS
*Director of the United States Patent and Trademark Office*